US006454395B1

(12) United States Patent
Irinoda

(10) Patent No.: US 6,454,395 B1
(45) **Date of Patent: *Sep. 24, 2002**

(54) ELECTROSTATIC INKJET HEAD AND MANUFACTURING METHOD THEREOF

(75) Inventor: Mitsugu Irinoda, Miyagi (JP)

(73) Assignee: Ricoh Company, Ltd., Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,040

(22) Filed: Aug. 4, 1999

(30) Foreign Application Priority Data

Aug. 4, 1998 (JP) ..... 10-220541

(51) Int. Cl.[7] ..... B41J 2/04

(52) U.S. Cl. ..... 347/54; 347/54; 347/70; 347/71

(58) Field of Search ..... 347/54, 20, 68, 347/71, 47, 44, 70, 40; 29/890.1; 399/261

(56) References Cited

U.S. PATENT DOCUMENTS 3,949,410 A * 4/1976 Bassous et al. ..... 347/75
5,513,431 A 5/1996 Ohno et al. ..... 29/890.1
5,534,900 A 7/1996 Ohno et al. ..... 347/54
6,332,669 B1 * 12/2001 Kato et al. ..... 347/54

FOREIGN PATENT DOCUMENTS

JP 5-50601 3/1993
JP 6-71882 3/1994

* cited by examiner

*Primary Examiner*—John Barlow
*Assistant Examiner*—Shih-wen Hsieh
(74) *Attorney, Agent, or Firm*—Eugene C. Rzucidlo

(57) ABSTRACT

An electrostatic inkjet head is constructed to operate such that a large margin is provided to a drive voltage and a deviation in the drive characteristic is significantly reduced. A vibration plate defines a part of an ink chamber connected to an inkjet nozzle. The vibration plate is elastically deformed so as to eject a droplet of ink from the inkjet nozzle. An individual electrode is located opposite to the vibration plate with a predetermined gap therebetween, the individual electrode being formed by processing a single crystal silicon substrate. Gap spacers are formed on the single crystal silicon substrate. The gap spacers are formed of insulating films so as to define a gap between the individual electrode and the vibration plate. The individual electrode is formed of a silicon film containing impurity atoms providing one of an n-type conductivity and a p-type conductivity to the individual electrode. The individual electrode is surrounded by the gap spacers.

23 Claims, 12 Drawing Sheets

ELECTROSTATIC INKJET HEAD AND MANUFACTURING METHOD THEREOF

BACKGROUND OF THE INVENTION

1. Field of the Invention

The present invention generally relates to an inkjet head and a manufacturing method thereof and, more particularly, to an electrostatic inkjet head having an individual electrode structure in which a vibration plate is driven by an electrostatic force generated by the individual electrode, and also relates to a method of manufacturing such an inkjet head.

2. Description of the Related Art

Japanese Laid-Open patent application No. 6-71882 discloses an electrostatic inkjet head used for an on-demand inkjet printer. The inkjet head disclosed in this patent application has a vibration plate and an individual electrode located opposite to the vibration plate. The individual electrode is formed by an n-type or p-type diffusion layer formed in a single crystal silicon (Si) substrate. The individual electrode is isolated from the Si substrate by a p-n junction. In such an inkjet head structure, the vibration plate is deformed by supplying a voltage to the individual electrode so as to discharge droplets of ink from a nozzle connected to a space defined by the vibration plate.

In the above-mentioned electrostatic inkjet head, the individual electrode is isolated from the Si substrate via the p-n junction. Accordingly, a leak current flowing through the p-n junction area varies due to a deviation in a process of forming the p-n junction. Thus, a problem such as an increased power consumption, an unstable operation of the inkjet head or an insufficient drive power generated by a drive circuit may be caused by the p-n junction leakage or generation of a p-n junction capacitance.

Additionally, in the above-mentioned inkjet head, the individual electrode comprises a diffusion layer formed by doping n-type or p-type impurities into the Si substrate, and a drive voltage is provided to the individual electrode. Accordingly, the drive voltage is limited by a width of a depletion layer, and, thereby, the drive voltage must be a relatively low voltage. Usually, the drive voltage has a sufficient margin relative to a junction destruction voltage. However, in the above-mentioned inkjet head, since a relatively low voltage must be provided to the individual electrode, there is a problem in that a margin in the drive voltage provided to the individual electrode is small.

Further, the above-mentioned patent application describes an example of the inkjet head in which an individual electrode is provided in a groove formed in a glass substrate, which groove defines a gap between the individual electrode and the vibration plate. Since the groove is formed via a dry or wet etching method, the gap between the individual electrode and the vibration plate cannot be precisely controlled. Accordingly, when a plurality of grooves are formed on a wafer substrate, a uniform gap cannot be reliably achieved. The gap is an important design parameter which determines a drive characteristic of the inkjet head. Thus, if the gap is not uniform, a uniform characteristic of the inkjet head cannot be achieved.

SUMMARY OF THE INVENTION

To overcome the problems described above, the preferred embodiments of the present invention provide an improved inkjet head and a manufacturing method thereof wherein the inkjet head achieves a large margin in a drive voltage and prevents deviation in a drive characteristic of the inkjet head.

According to one preferred embodiment of the present invention, an electrostatic inkjet head has at least one ink chamber connected to an inkjet nozzle and is formed of a silicon substrate, the electrostatic Inkjet nozzle includes a vibration plate defining a part of the ink chamber, the vibration plate being elastically deformable so as to eject a droplet of ink from the inkjet nozzle, an individual electrode located opposite to the vibration plate with a predetermined gap therebetween, the individual electrode including a single crystal silicon substrate, and gap spacers disposed on the single crystal silicon substrate, the gap spacers being made of an insulating film so as to define the gap between the individual electrode and the vibration plate, wherein the individual electrode is made of a silicon film containing impurity atoms providing one of an n-type conductivity and a p-type conductivity to the individual electrode, and the individual electrode is surrounded by the gap spacers.

According to the above-mentioned preferred embodiment of the present invention, the individual electrode is surrounded by the gap spacers which are made of insulating films. Thus, the individual electrode is electrically insulated from other parts of the inkjet head such as the single crystal silicon substrate or other individual electrodes. As a result, a leak current from the individual electrode is significantly reduced which results in a low-power consumption inkjet head. Additionally, a margin of voltage between the individual electrodes is increased, which results in an increase in freedom of a driving voltage used to drive the inkjet head. Further, since the individual electrode is formed of the silicon film containing impurity atoms which provide an n-type conductivity or a p-type conductivity to the individual electrode, a resistance of the individual electrode is reduced, which results in a high-speed operation of the inkjet head.

In the electrostatic inkjet head according to preferred embodiments of the present invention, the silicon film forming the individual electrode may contain impurity atoms at a concentration of more than about $1E18/cm^3$. Accordingly, an ohmic contact can be easily obtained which increases reliability. Additionally, since a resistance of the individual electrode is reduced, a high-speed operation can be achieved.

The impurity atoms contained in the silicon film forming the individual electrode may be phosphorus atoms or arsenic atoms. Additionally, the impurity atoms contained in the silicon film forming the individual electrode may be boron atoms. This enables use of a manufacturing line of a conventional LSI semiconductor device, which results in reduction in a manufacturing cost of the inkjet head.

Additionally, there is provided according to another preferred embodiment of the present invention, an electrostatic inkjet head having at least one ink chamber connected to an inkjet nozzle, the electrostatic inkjet head including a silicon substrate, the electrostatic inkjet nozzle including a vibration plate defining a part of the ink chamber, the vibration plate being elastically deformable by an electrostatic force so as to eject a droplet of ink from the inkjet nozzle, an individual electrode located opposite to the vibration plate with a predetermined gap therebetween, the individual electrode being made of a single crystal silicon substrate, and gap spacers formed on the single crystal silicon substrate, the gap spacers including an insulating film arranged to define the gap between the individual electrode and the vibration plate, wherein the individual electrode includes a silicon film and a silicide film formed on the silicon film, the silicon film lacking impurity atoms providing one of an n-type conductivity and a p-type conductivity to the individual electrode, and the individual electrode is surrounded by the gap spacers.

According to the preferred embodiment described in the preceding paragraph, the individual electrode is surrounded by the gap spacers which are made of insulating films. Thus, the individual electrode is electrically insulated from other parts of the inkjet head such as the single crystal silicon substrate or other individual electrodes. Thus, a leak current from the individual electrode can be reduced which results in a low-power consumption inkjet head. Additionally, a margin of voltage tolerance between the individual electrodes is increased, which results in an increase in freedom of a driving voltage for driving the inkjet head. Further, since the individual electrode is made of the silicon film and the silicide film formed on the silicon film, a resistance of the individual electrode can be reduced without introducing impurity atoms into the silicon film, which results in a high-speed operation of the inkjet head.

Additionally, in the electrostatic inkjet head according to preferred embodiments of the present invention, the individual electrode may include a silicide film formed on the silicon film containing the impurity atoms. Accordingly, a resistance of the individual electrode can be greatly reduced, which results in a high-speed operation of the inkjet head.

In the electrostatic inkjet head according to preferred embodiments of the present invention, the silicide film may be made of titanium silicide. Since the titanium silicide has excellent heat resistance, there is less limitation in the subsequent heat treatment and a freedom in process design is increased. Additionally, this enables use of a process line of a conventional LSI semiconductor device, which results in reduction in a manufacturing cost of the inkjet head.

The electrostatic inkjet head according to preferred embodiments of the present invention may further include an insulating film formed on the silicon film of the individual electrode. The insulating film prevents the vibration plate from contacting the individual electrode during operation. Thus, a malfunction due to short-circuiting between the vibration plate and the individual electrode can be prevented.

Additionally, in the electrostatic inkjet head according to preferred embodiments of the present invention, the insulating film may be made of silicon nitride. Since the silicon nitride has excellent insulation characteristics, a malfunction due to short-circuiting between the vibration plate and the individual electrode can be reliably prevented. Additionally, use of the silicon nitride enables allows a manufacturing line of a conventional LSI semiconductor device to be used, which results in reduction in a manufacturing cost of the inkjet head. Further, since the silicon nitride film used as a mask for forming the individual electrode can be used as an insulating film on the individual electrode, a number of process steps required for manufacturing the inkjet head is reduced.

Alternatively, the insulating film may be made of silicon oxide. Since the silicon oxide has excellent insulation characteristics, a malfunction due to short-circuiting between the vibration plate and the individual electrode can be reliably prevented. Additionally, use of the silicon oxide enables use of a process line of a conventional LSI semiconductor device, which results in reduction in a manufacturing cost of the inkjet head.

Additionally, according to another preferred embodiment of the present invention, methods for manufacturing the above-mentioned electrostatic inkjet heads are provided.

Other objects, features and advantages of the present invention will become more apparent from the following detailed description when read in conjunction with the accompanying drawings.

BRIEF DESCRIPTION OF THE DRAWINGS

FIGS. 2A, 2B, 2C, 2D, 2E, 2F, 2G, 2H, 21, 2J, 2K, 2L, 2M and 2N are cross-sectional views for explaining a manufacturing process of the inkjet head according to the first preferred embodiment of the present invention;

FIGS. 4A, 4B, 4C, 4D, 4E, 4F, 4G, 4H, 41, 4J, 4K, 4L, 4M, 4N, 40 and 4P are cross-sectional views for explaining a manufacturing process of the inkjet head according to the second preferred embodiment of the present invention;

FIGS. 6A, 6B, 6C, 6D, 6E, 6F, 6G, 6H, 61, 6J, 6K, 6L, 6M, 6N, 60, 6P, 6Q, 6R, 6S and 6T are cross-sectional views for explaining a manufacturing process of the inkjet head according to the third preferred embodiment of the present invention;

DETAILED DESCRIPTION OF PREFERRED EMBODIMENTS

Figure 1A:
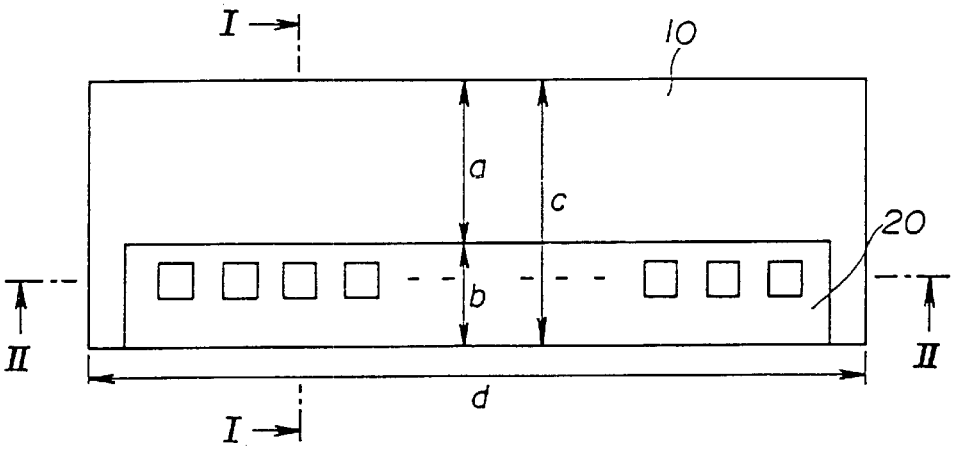
FIG. 1A is a plan view of an inkjet head according to a first preferred embodiment of the present invention.
Figure 1B:
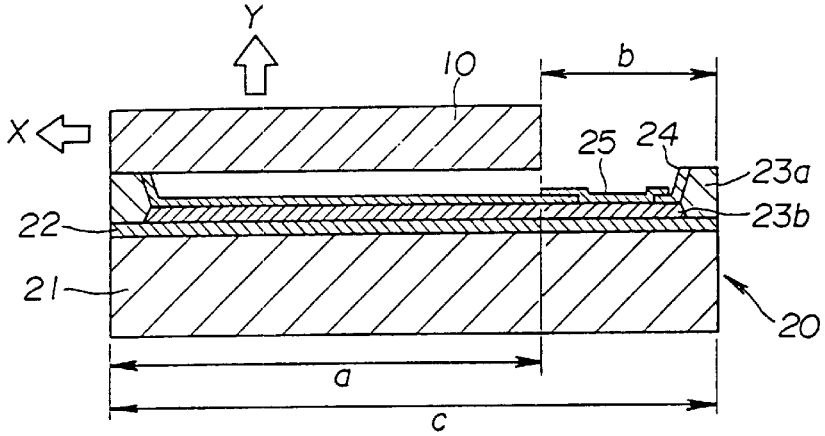
FIG. 1B is a cross-sectional view of the inkjet head shown in FIG. 1A taken along a line I—I of FIG. 1A.
Figure 1C:
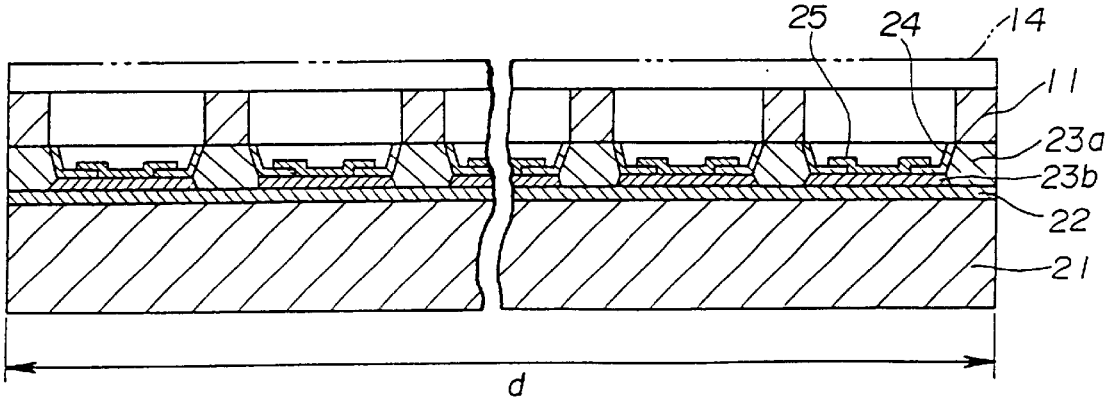
FIG. 1C is a cross-sectional view of the inkjet head shown in FIG. 1A taken along a line II—II of FIG. 1A.

A description will now be given, with reference to FIGS. 1A, 1B and 1C, of a first preferred embodiment of the present invention. FIG. 1A is a plan view of an inkjet head according to the first preferred embodiment of the present invention. FIG. 1B is a cross-sectional view of the inkjet head shown in FIG. 1A taken along a line I—I of FIG. 1A, and FIG. 1C is a cross-sectional view of the inkjet head shown in FIG. 1A taken along a line II—II of FIG. 1A.

The inkjet head according to the present preferred embodiment includes an ink-chamber substrate 10 and an electrode substrate 20. The ink-chamber substrate 10 is preferably formed of a single crystal silicon (Si) substrate. A plurality of inkjet nozzles are formed on the ink-chamber substrate 10 via an anisotropic etching method. A plurality of individual ink-chambers are formed inside of the ink-chamber substrate 10 so that each of the inkjet nozzles is provided for a respective one of the individual ink-chambers. A common ink-chamber is also formed inside of the ink-chamber substrate 10. The common ink-chamber is connected to each of the individual ink-chambers by passages formed via an anisotropic etching method so that ink is supplied to each of the individual ink-chambers from the common ink-chamber. A part of a wall constituting each of the individual ink-chambers defines a thin silicon film vibration plate which is driven by an electrostatic force. The thin silicon film vibration plate is located opposite to an individual electrode provided on the electrode substrate 20.

The electrode substrate 20 is also formed of a single crystal silicon (Si) substrate 21 which contains n-type or p-type impurity atoms. Normally, a single crystal Si substrate having a plane orientation (100) is used for the substrate 21. However, a-single crystal Si substrate having a plane orientation (110) or (111) may be used depending on a process or method to be used. A silicon oxide film 22 is formed on the Si substrate 21, and individual electrodes 23*b* are formed on the silicon oxide film 22 which defines an insulating layer. The individual electrodes 23*b* are made of an n-type or p-type polycrystalline silicon or an n-type or p-type single crystal silicon. The individual electrodes 23*b* contain impurity atoms implanted by an impurity introducing method such as an ion implantation method, a coating diffusion method or a solid diffusion method. The individual electrodes 23*b* preferably contain impurity atoms of more than about 1E18/cm$^3$. Additionally, insulating gap spacers 23*a* are formed on the silicon oxide film 22 so that each of the individual electrodes 23*b* is located inside a space defined by the insulating gap spacers 23*a*.

The insulating gap spacers 23*a* are preferably made of a silicon (Si) oxidation film formed via a thermal oxidation method. The insulating gap spacers 23*a* define a gap between the vibration plates formed in the ink-chamber substrate 10 and the individual electrodes 23*b* formed in the electrode substrate 20. That is, an electrostatic force is generated between each of the vibration plates and the respective one of the individual electrodes 23*b* separated by the gap defined by the gap spacers 23*a*.

Insulating films 24 are formed on walls of the insulating gap spacers 23*a* and the individual electrodes 23*b* so as to maintain insulation between each of the individual electrodes 23*b* and the respective one of the vibration plates formed in the ink-chamber substrate 10. The insulating films 24 are silicon nitride films preferably formed by a chemical vapor deposition (CVD) method or a sputtering method. It should be noted that the insulating films 24 may be omitted if an insulation is not necessary. A voltage applying pad 25 is formed on each of the insulating films 24. A part of each of the voltage applying pads 25 is connected to a respective one of the individual electrodes 23*b* so as to apply a voltage to the respective one of the individual electrodes 23*b*.

In FIGS. 1A, 1B and 1C, an area indicated by an arrow b is an opening through which a flexible printed circuit board (FPC) or a bonding wire is connected to each of the voltage applying pads 25. Additionally, arrows X and Y shown in FIG. 1B are directions of a droplet of ink projected from each of the inkjet nozzles provided on the ink-chamber substrate 10. That is, when the inkjet nozzles are provided on a side surface of the ink-chamber substrate 10, the droplet of ink is projected in the direction indicated by the arrow X. When the inkjet nozzles are provided on a top surface of the ink-chamber substrate 10, the droplet of ink is projected in the direction indicated by the arrow Y.

A description will now be given, with reference to FIGS. 2A through 2N, of an example of method of manufacturing an inkjet head according to the above-mentioned first preferred embodiment shown in FIGS. 1A, 1B and 1C. It should be noted that FIGS. 2B, 2D, 2F, 2H, 2J, 2L and 2N are cross-sectional views taken along a line I—I of FIGS. 2A, 2C, 2E, 2G, 21, 2K and 2M, respectively.

Figure 2A:
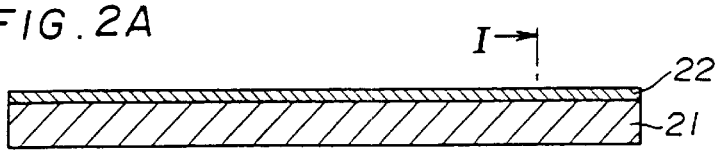
Figure 2B:
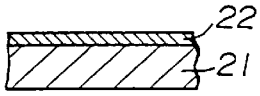

First, as shown in FIGS. 2A and 2B, the insulating film 22 is formed on the single crystal silicon substrate 21 via a thermal oxidation method, a chemical vapor deposition method or a sputtering method. The single crystal silicon substrate 21 is of an n-type or a p-type, and preferably has a thickness of about 400 $\mu$m to about 700 $\mu$m and an electrical resistivity of about 5 $\Omega$-cm$^3$ to about 30 $\Omega$-cm$^3$. Plane orientation of the single crystal silicon substrate 21 is preferably (100), (111) or (110). The insulating film 22 provides insulation between the individual electrodes and the single crystal silicon substrate 21.

Figure 2C:
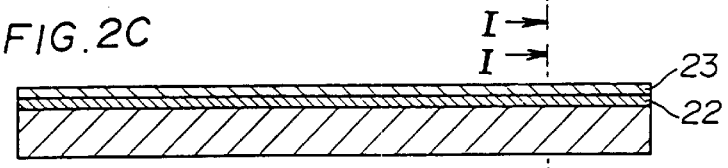
Figure 2D:
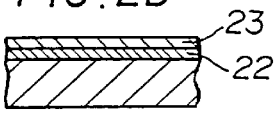

Thereafter, as shown in FIGS. 2C and 2D, a silicon film 23 is formed on the insulating film 22. The silicon film 23 can be formed of an n-type or p-type polycrystalline silicon or an n-type or p-type single crystal silicon. The silicon film 23 preferably contains impurity atoms of about 1E18/cm$^3$ which can be implanted via an impurity introducing method such as an ion implantation method, a coating diffusion method or a solid diffusion method.

Figure 2E:
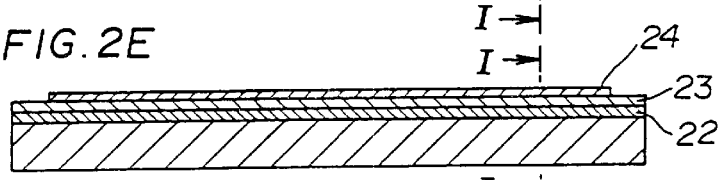
Figure 2F:
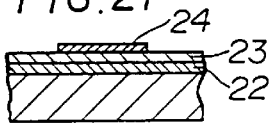

Thereafter, as shown in FIGS. 2E and 2F, the insulating film 24 is formed on the silicon film 23 via a chemical vapor deposition (CVD) method or a sputtering method. The insulating film is preferably made of a silicon nitride film so as to prevent diffusion of oxygen. Then, the insulating film 24 is patterned via a regular photolithography process and a dry or wet etching method so as to form parts corresponding to the individual electrodes 23*b*.

Figure 2G:
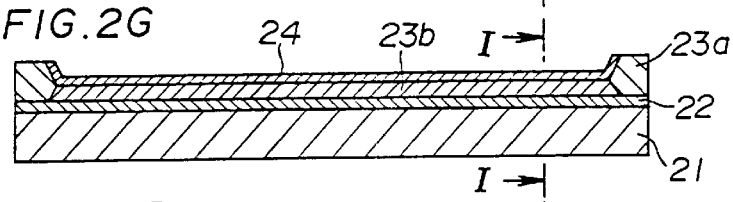
Figure 2H:
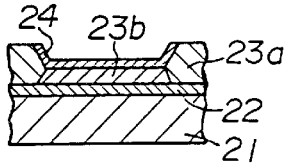

Thereafter, the silicon film 23 is oxidized by being placed in an oxygen atmosphere in an electric oven. At this time, a first area of the silicon film 23, at which first area the insulating film 24 for preventing oxygen diffusion is not formed, is oxidized. Thus, a thick silicon oxidation film 23*a* is formed as shown in FIGS. 2G and 2H. On the other hand, a second area of the silicon film 23, at which second area the insulating film 24 for preventing oxygen diffusion is formed, is not oxidized. Thus, the thickness of the silicon film 23 in the second area remains unchanged as shown in FIGS. 2G and 2H. Since the silicon oxidation film 23*a* and the silicon film 23*b* have different thicknesses, a step is formed between the silicon oxidation film 23*a* and the silicon film 23*b*. This step corresponds to the gap between the individual electrodes and the vibration plates in the inkjet head according to preferred embodiments of the present embodiment. Although the insulating film is not removed in the present preferred embodiment after the silicon oxidation film 23*a* is formed, the insulating film 24 may be removed after the silicon oxidation film 23*a* is formed, if desired.

Figure 2I:
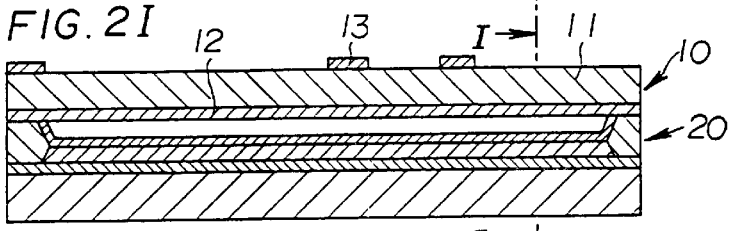
Figure 2J:
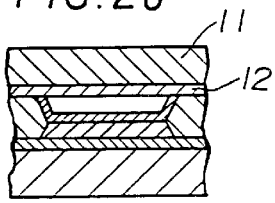

Thereafter, as shown in FIGS. 2I and 2J, a single crystal silicon substrate 11 (corresponding to the ink-chamber substrate 10) is joined to the electrode substrate 20 which is in an intermediate state as shown in FIGS. 2I and 2J. The single crystal silicon substrate 11 is of an n-type or a p-type, and has a plane orientation (110). A diffusion layer 12 and single crystal silicon etching mask patterns 13 are previously formed on the single crystal silicon substrate 11. The diffusion layer 12 contains n-type or p-type having impurities of more than about 1E19/$cm^3$. A thickness of the diffusion layer 12 is preferably substantially equal to a thickness of the vibration plate. The single crystal silicon etching patterns 13 are formed on a surface of the single crystal silicon substrate 11, which surface is opposite to the surface on which the diffusion layer 12 is formed. The etching mask patterns 13 are preferably formed of a silicon oxide film, a silicon nitride film or a tantalum peroxide film. The etching mask patterns 13 are provided so as to define areas in which ink chambers and inkjet nozzles are formed. It should be noted that the substrate 11 can be a silicon on insulator (SOI) substrate which is constituted by a single crystal silicon substrate and a single crystal thin silicon film formed on the single crystal silicon substrate via a silicon oxide film.

The ink-chamber substrate 10 can be joined to the electrode substrate 20 via a direct bonding method or an anode bonding method. In the direct bonding method, the bonding is performed preferably at a temperature of more than about 800° C. within an oxygen atmosphere at a normal pressure or a reduced pressure. In the anode bonding method, an insulating film containing mobile ions such as Na ions or H ions is formed on the single crystal silicon substrate preferably via a sputtering method, and, thereafter, the bonding is performed by applying an electric field at a temperature ranging from about 200° C. to about 500° C., and preferably from about 350° C. to about 450° C. Additionally, it is preferable that before the bonding is performed, the silicon oxidation film 23*a* of the electrode substrate 20 is polished via a chemical mechanical polishing process so as to planarize the surface to be bonded.

Figure 2K:
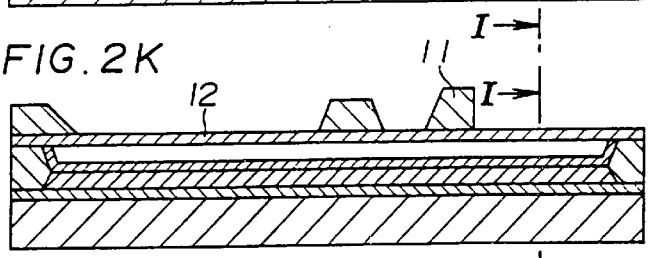
Figure 2L:
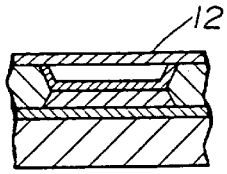

After the ink-chamber substrate 10 is bonded to the electrode substrate 20, the ink-chamber substrate 10 (the single crystal silicon substrate 11) is etched preferably via an anisotropic etching method on the surface provided with the etching mask patterns 13. The anisotropic etching is performed by using KOH or TMAH. The etching is stopped by the diffusion layer 12 which contains impurities at a high concentration. Accordingly, the diffusion layer 12 remains as the vibration plate as shown in FIGS. 2K and 2L. If the SOI substrate is used, the etching is stopped by the silicon oxide film. In such a case, the silicon oxide film on the SOI substrate may be removed after the etching.

Figure 2M:
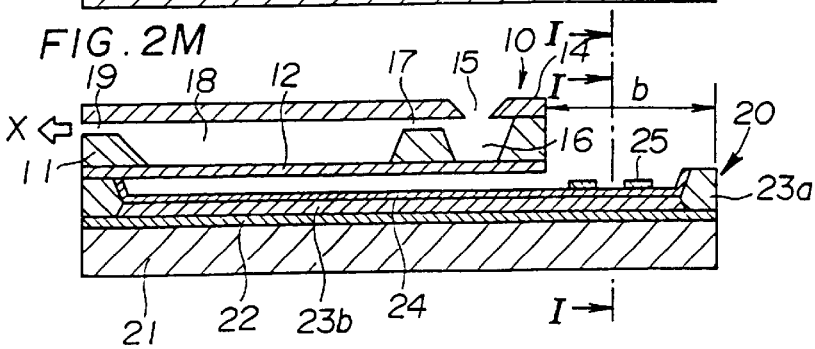
Figure 2N:
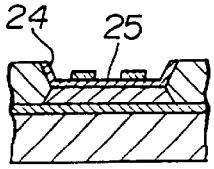

Thereafter, an ink-chamber cover 14 is bonded to the substrate 11 so as to form the individual ink-chambers 18 and the common ink-chamber 16 as shown in FIG. 2M. The ink-chamber cover 14 is preferably formed of a glass plate or a metal plate. A passage 15 for supplying ink to the common ink-chamber 16 is previously formed in the ink-chamber cover 14 preferably via sand blasting or laser machining. Additionally, the crystal silicon thin film 12 corresponding to a pad area (an area indicated by arrow b) is removed by etching. Then, the voltage applying pads 25 are formed on the individual electrodes 23*b*.

As shown in FIG. 2M, each of the inkjet nozzles 19 is provided for a respective one of the individual ink-chambers 18. Each of the individual ink-chambers 18 is connected to the common ink-chamber 16 by the passage 17.

When a predetermined voltage is applied to the voltage applying pad 25 which is connected to the individual electrode 23*b*, an electrostatic force is generated between the vibration plate 12 and the individual electrode 23*b* which results in warpage of the vibration plate 12 toward the individual electrode 23*b*. Accordingly, ink is introduced into the individual ink-chamber 18 via the passage 15, the common ink-chamber 16 and the passage 17. When the supply of the voltage is stopped, the vibration plate 12 returns to the original position due to its elasticity. At this time, the ink in the individual ink-chamber 18 is pressurized, and a droplet of the ink is discharged from the inkjet nozzle 19 in a direction indicated by an arrow X in FIG. 2M so that the droplet of the ink is projected onto a recording paper.

In the present preferred embodiment, although the inkjet nozzle 19 is formed so that a droplet of ink is projected in the direction (horizontal direction) indicated by the arrow X, the droplet of ink may be projected in a vertical direction by changing the position of the inkjet nozzle 19. Additionally, the inkjet nozzle 19 may be formed after the ink-chamber substrate 10 and the electrode substrate 20 are bonded to each other.

Figure 3A:
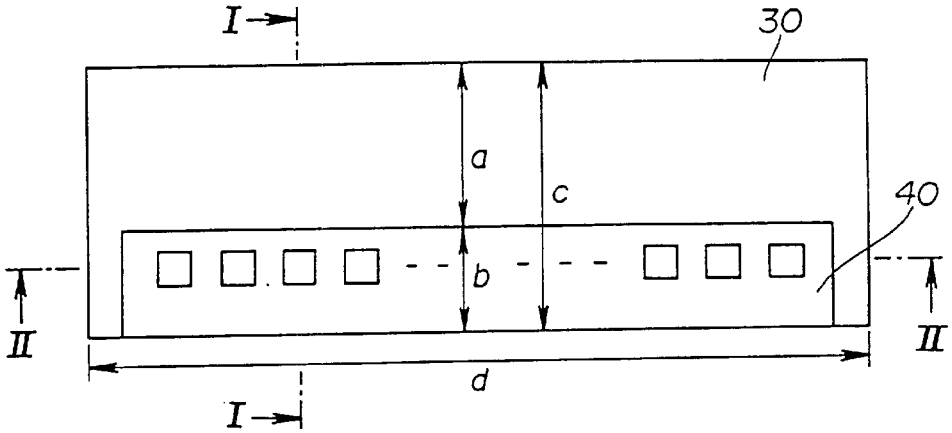
FIG. 3A is a plan view of an inkjet head according to a second preferred embodiment of the present invention.
Figure 3B:
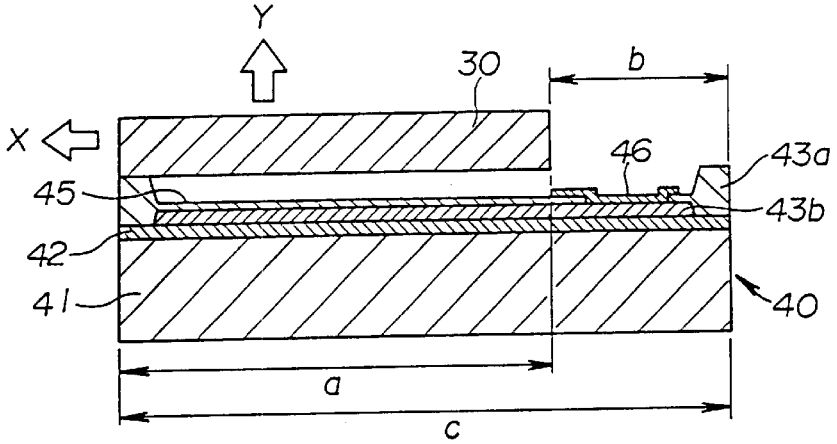
FIG. 3B is a cross-sectional view of the inkjet head shown in FIG. 3A taken along a line I—I of FIG. 3A.
Figure 3C:
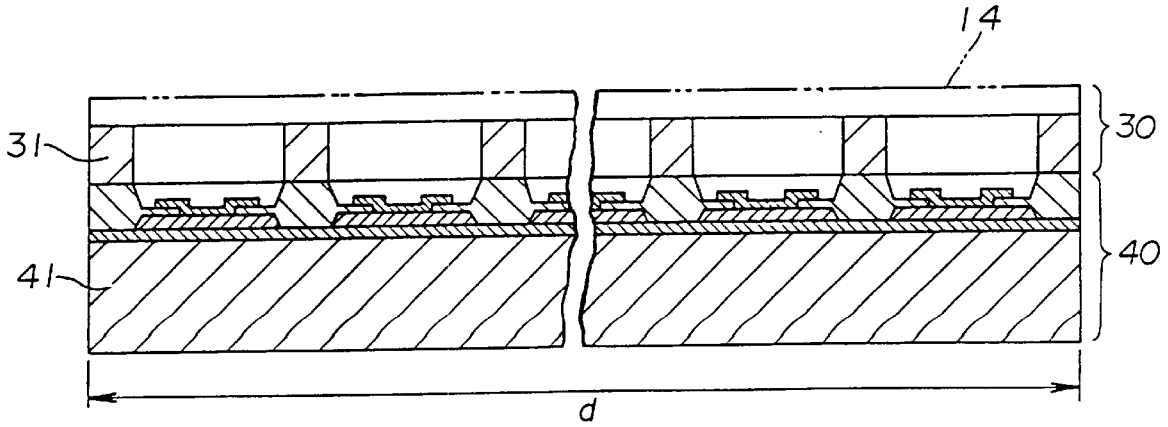
FIG. 3C is a cross-sectional view of the inkjet head shown in FIG. 3A taken along a line II—II of FIG. 3A.

A description will now be given, with reference to FIGS. 3A, 3B and 3C, of a second preferred embodiment of the present invention. FIG. 3A is a plan view of an inkjet head according to the second preferred embodiment of the present invention. FIG. 3B is a cross-sectional view of the inkjet head shown in FIG. 3A taken along a line I—I of FIG. 3A, and FIG. 3C is a cross-sectional view of the inkjet head shown in FIG. 3A taken along a line II—II of FIG. 3A.

The inkjet head according to the present preferred embodiment includes an ink-chamber substrate 30 and an electrode substrate 40. The ink-chamber substrate 30 is preferably formed of a single crystal silicon (Si) substrate. A plurality of inkjet nozzles are formed on the ink-chamber substrate 30 preferably via an anisotropic etching method. A plurality of individual ink-chambers are formed inside of the ink-chamber substrate 30 so that each of the inkjet nozzles is provided for a respective one of the individual ink-chambers. A common ink-chamber is also formed inside of the ink-chamber substrate 30. The common ink-chamber is connected to each of the individual ink-chambers via passages formed preferably via an anisotropic etching method so that ink is supplied to each of the individual ink-chambers from the common ink-chamber. A part of a wall constituting each of the individual ink-chambers defines a thin silicon film vibration plate which is driven by an electrostatic force.

The thin silicon film vibration plate is located opposite to an individual electrode formed on the electrode substrate 40.

The electrode substrate 20 is also formed of a single crystal silicon (Si) substrate 41 which contains n-type or p-type impurity atoms. Normally, a single crystal Si substrate having a plane orientation (100) is used for the substrate 41. However, a single crystal Si substrate having a plane orientation (110) or (111) may be used depending on a process or method to be used. A silicon oxide film 42 is formed on the Si substrate 41, and individual electrodes 43*b* are formed on the silicon oxide film 42 which defines an insulating layer. The individual electrodes 43*b* are made of an n-type or p-type polycrystalline silicon or an n-type or p-type single crystal silicon. The individual electrodes 43*b* contain impurity atoms implanted by an impurity introducing method such as an ion implantation method, a coating diffusion method or a solid diffusion method. The individual electrodes 43*b* preferably contain impurity atoms of more than about 1E18/cm$^3$. Additionally, insulating gap spacers 43*a* are arranged on the silicon oxide film 42 so that each of the individual electrodes 43*b* is located inside a space defined by the insulating gap spacers 43*a*.

The insulating gap spacers 43*a* are preferably made of a silicon (Si) oxide film formed by a thermal oxidation method. The insulating gap spacers 43*a* define a gap between the vibration plates formed in the ink-chamber substrate 30 and the individual electrodes 43*b* formed in the electrode substrate 40. That is, an electrostatic force is generated between each of the vibration plates and the respective one of the individual electrodes 43*b* separated by the gap defined by the gap spacers 43*a*.

A silicon oxide insulating film 45 is formed on each of the individual electrodes 43*b* so as to maintain insulation between each of the individual electrodes 43*b* and the respective one of the vibration plates formed in the ink-chamber substrate 30. A voltage applying pad 46 is formed on the silicon oxide insulating film 45. A part of the voltage applying pad 46 is connected to the individual electrode 43*b* so as to apply a voltage to the individual electrode 43*b*.

In FIGS. 3A, 3B and 3C, an area indicated by an arrow b is an opening through which a flexible printed circuit board (FPC) or a bonding wire is connected to each of the voltage applying pads 46. Additionally, arrows X and Y shown in FIG. 3B are directions of a droplet of ink projected from each of the inkjet nozzles formed on the ink-chamber substrate 30. That is, when the inkjet nozzles are provided on a side surface of the ink-chamber substrate 30, the droplet of ink is projected in the direction indicated by the arrow X. When the inkjet nozzles are provided on a top surface of the ink-chamber substrate 30, the droplet of ink is projected in the direction indicated by the arrow Y.

Figure 4A:
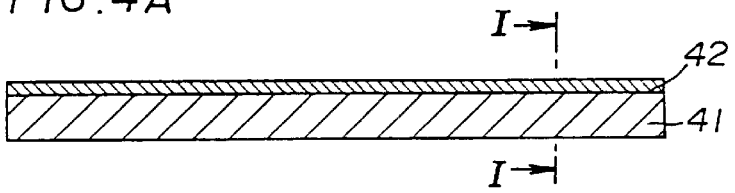

A description will now be given, with reference to FIGS. 4A through 4P, of an example of a method of manufacturing of the inkjet head according to the above-mentioned second preferred embodiment shown in FIGS. 3A, 3B and 3C. FIGS. 4A through 4P are cross-sectional views for explaining the manufacturing process of the inkjet head according to the second preferred embodiment of the present invention. It should be noted that FIGS. 4B, 4D, 4F, 4H, 4J, 4L, 4N and 4P are cross-sectional views taken along a line I—I of FIGS. 4A, 4C, 4E, 4G, 4I, 4K, 4M and 40, respectively.

Figure 4B:
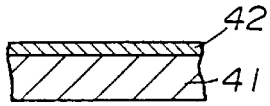

First, as shown in FIGS. 4A and 4B, the insulating film 42 is formed on the single crystal silicon substrate 41 preferably via a thermal oxidation method, a chemical vapor deposition method or a sputtering method. The single crystal silicon substrate 41 is an n-type or a p-type, and preferably has a thickness of about 400 $\mu$m to about 700 $\mu$m and an electrical resistivity of about 5 Ω-cm$^3$ to about 30 Ω-cm$^3$. Plane orientation of the single crystal silicon substrate 41 is preferably (100), (111) or (110). The insulating film 42 provides an insulation between the individual electrodes and the single crystal silicon substrate 41.

Figure 4C:
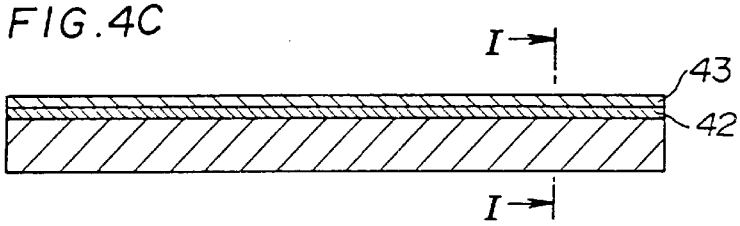
Figure 4D:
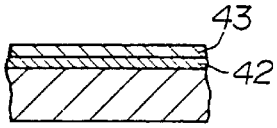

Thereafter, as shown in FIG. 4C and 4D, a silicon film 43 is formed on the insulating film 42. The silicon film 43 can be formed of an n-type or p-type polycrystalline silicon or an n-type or p-type single crystal silicon. The silicon film 43 preferably contains impurity atoms of about 1E18/cm$^3$ which can be implanted via an impurity introducing method such as an ion implantation method, a coating diffusion method or a solid diffusion method.

Figure 4E:
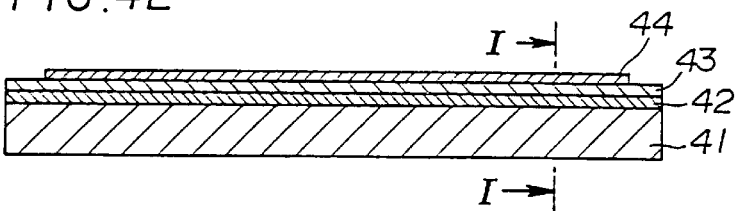
Figure 4F:
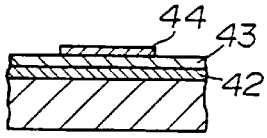

Thereafter, as shown in FIGS. 4E and 4F, the insulating film 44 is formed on the silicon film 43 by a chemical vapor deposition (CVD) method or a sputtering method. The insulating film 44 is made of a silicon nitride film so as to prevent diffusion of oxygen. Then, the insulating film 44 is patterned via a regular photolithography and a dry or wet etching method so as to form parts corresponding to the individual electrodes 23*b*.

Figure 4G:
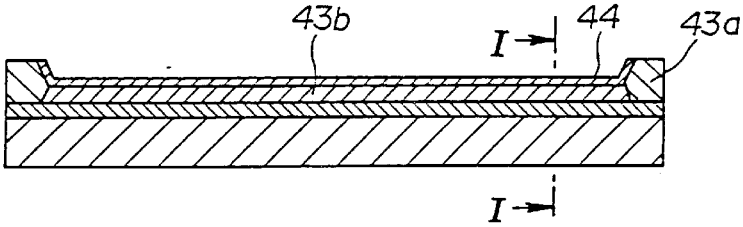
Figure 4H:
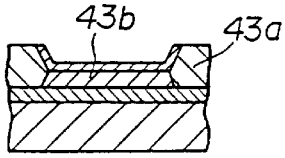
Figure 4I:
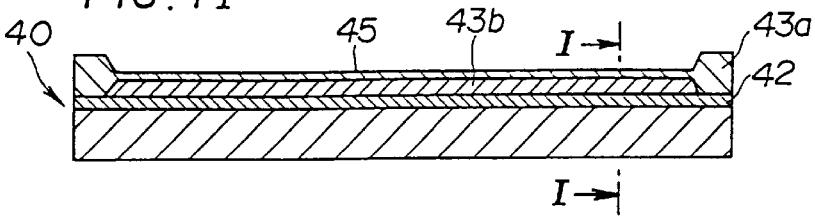
Figure 4J:
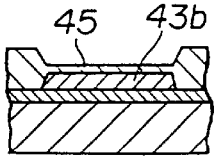

Thereafter, the silicon film 43 is oxidized by being placed in an oxygen atmosphere in an electric furnace. At this time, a first area of the silicon film 43 in which first area the insulating film 44 for preventing oxygen diffusion is not formed is oxidized. Thus, a thick silicon oxidation film 43*a* is formed as shown in FIGS. 4G and 4H. On the other hand, a second area of the silicon film 43 in which the insulating film 44 for preventing oxygen diffusion is formed is not oxidized. Thus, the thickness of the silicon film 43 in the second area remains unchanged as shown in FIGS. 4G and 4H. Since the silicon oxidation film 43*a* and the silicon film 43*b* have different thicknesses, a step is formed between the silicon oxide film 43*a* and the silicon film 43*b*. This step corresponds to the gap between the individual electrodes and the vibration palates in the inkjet head according to the present preferred embodiment. The insulating film 44 is removed after the silicon oxide film 43*a* is formed. Then, a silicon oxide film 45 is formed on the silicon film 43*b*, as shown in FIGS. 41 and 4J, by placing the substrate 41 in an oxygen atmosphere in an electric furnace.

Figure 4K:
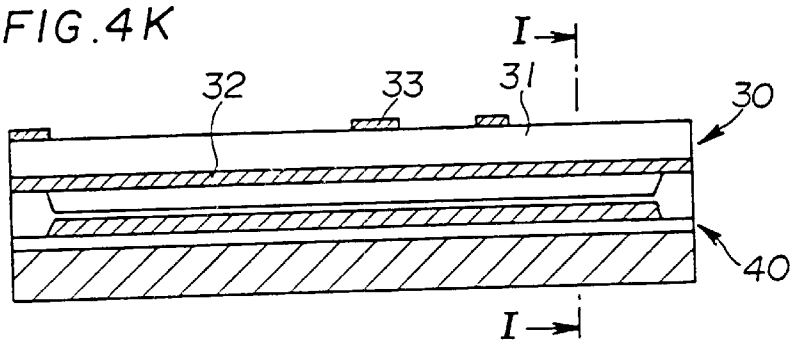
Figure 4L:
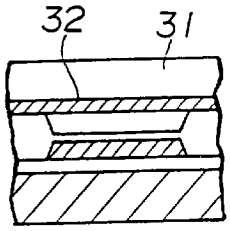

Thereafter, as shown in FIGS. 4K and 4L, a single crystal silicon substrate 31 (corresponding to the ink-chamber substrate 30) is joined to the electrode substrate 40 which is in an intermediate state. The single crystal silicon substrate 31 is an n-type or a p-type, and has a plane orientation (110). A diffusion layer 32 and single crystal silicon etching mask patterns 33 are previously formed on the single crystal silicon substrate 31. The diffusion layer 32 contains n-type or p-type impurities of more than about 1E19/cm$^3$. A thickness of the diffusion layer 32 is preferably substantially equal to a thickness of the vibration plate. The single crystal silicon etching patterns 33 are formed on a surface of the single crystal silicon substrate 31, which surface is opposite to the surface on which the diffusion layer 32 is formed. The etching mask patterns 33 are formed of a silicon oxide film, a silicon nitride film or a tantalum peroxide film. The etching mask patters 33 are arranged so as to define areas in which ink chambers and inkjet nozzles are formed. It should be noted that the substrate 31 can be a silicon on insulator (SOI) substrate which is constituted by a single crystal silicon substrate and a single crystal thin silicon film formed on the single crystal silicon substrate via a silicon oxidation film.

The ink-chamber substrate 30 can be joined to the electrode substrate 40 preferably via a direct bonding method or an anode bonding method. In the direct bonding method, the bonding is performed preferably at a temperature of more than about 800° C. within an oxygen atmosphere at a normal pressure or a reduced pressure. In the anode bonding method, an insulating film containing mobile ions such as Na ions or H ions is formed on the single crystal silicon substrate via a sputtering method, and, thereafter, the bonding is performed by applying an electric field at a temperature ranging from about 200° C. to about 500° C., and preferably from about 350° C. to about 450° C. Additionally, it is preferable that before the bonding is performed, the silicon oxide film 23*a* of the electrode substrate 20 is polished via a chemical mechanical polishing process so as to planarize the surface to be bonded.

Figure 4M:
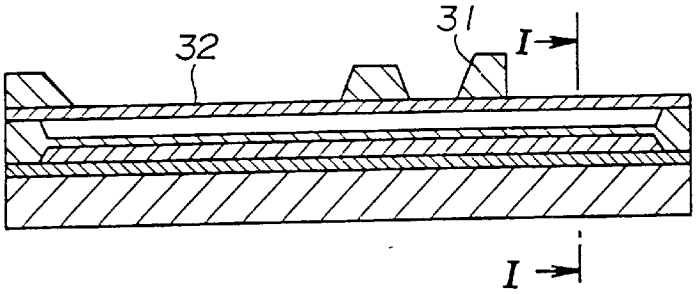
Figure 4N:
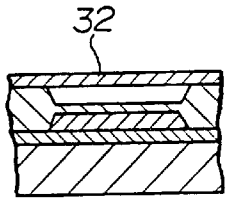
Figure 4U:
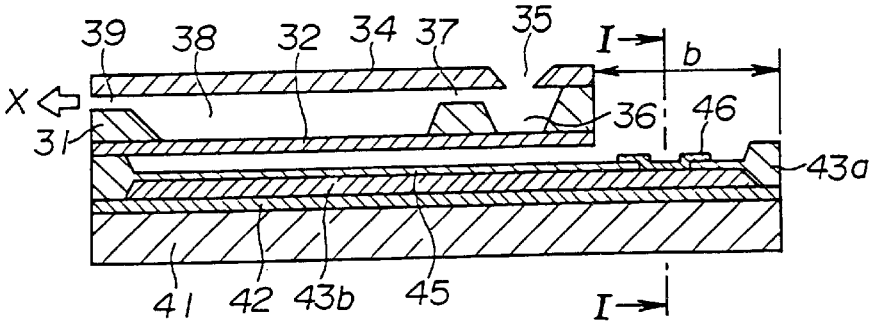
Figure 4P:
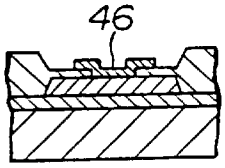

After the ink-chamber substrate 30 is bonded to the electrode substrate 40, the ink-chamber substrate 30 (the single crystal silicon substrate 31) is etched via an anisotropic etching method on the surface provided with the etching mask patterns 33. The anisotropic etching is performed by using KOH or TMAH. The etching is stopped by the diffusion layer 32 which contains impurities at a high concentration. Accordingly, the diffusion layer 32 remains as the vibration plate as shown in FIGS. 4M and 4N. If the SOI substrate is used, the etching is stopped by the silicon oxide film. In such a case, the silicon oxide film on the SOI substrate may be removed after the etching.

Thereafter, an ink-chamber cover 34 is bonded to the substrate 31 so as to form the individual ink-chambers 38 and the common ink-chamber 36 as shown in FIG. 40. The ink-chamber cover 34 is preferably formed of a glass plate or a metal plate. A passage 35 for supplying ink to the common ink-chamber 36 is previously formed in the ink-chamber cover 34 preferably via sand blasting or laser machining.

Additionally, the single crystal silicon thin film 32 corresponding to a pad area (an area indicated by arrow b) is removed by etching. Then, the voltage applying pads 46 are formed on the individual electrodes 43*b*.

As shown in FIG. 4O, each of the inkjet nozzles 39 is provided for a respective one of the individual ink-chambers 38. Each of the individual ink-chambers 38 is connected to the common ink-chamber 36 via the passage.

When a predetermined voltage is applied to the voltage applying pad 46 which is connected to the individual electrode 43*b*, an electrostatic force is generated between the vibration plate 32 and the individual electrode 43*b* which results in warpage of the vibration plate 32 toward the individual electrode 43*b*. Accordingly, ink is introduced into the individual ink-chamber 38 via the passage 35, the common ink-chamber 36 and the passage 37. When the supply of the voltage is stopped, the vibration plate 32 returns to the original position due to its elasticity. At this time, the ink in the individual ink-chamber 38 is pressurized, and a droplet of the ink is discharged from the inkjet nozzle 39 in a direction indicated by an arrow X in FIG. 4O so that the droplet of the ink is projected onto a recording paper.

In the present preferred embodiment, although the inkjet nozzle 39 is formed so that a droplet of ink is projected in the direction (horizontal direction) indicated by the arrow X, the droplet of ink may be projected in a vertical direction by changing the position of the inkjet nozzle 39. Additionally, the inkjet nozzle 39 may be formed after the ink-chamber substrate 30 and the electrode substrate 40 are bonded to each other.

Figure 5A:
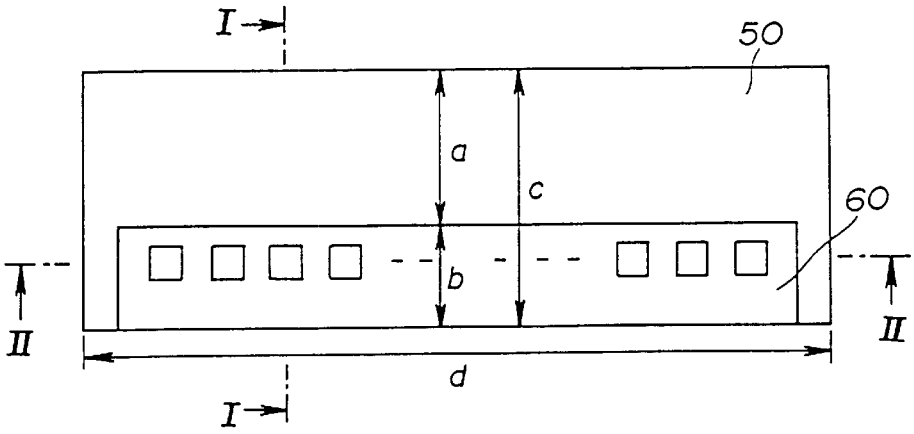
FIG. 5A is a plan view of an inkjet head according to a third preferred embodiment of the present invention.
Figure 5B:
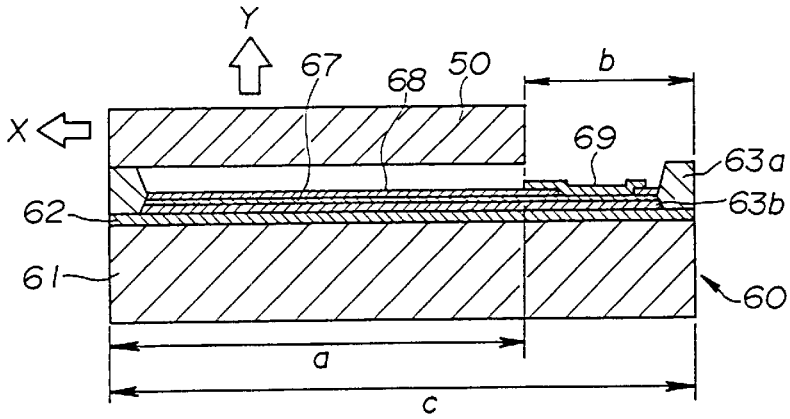
FIG. 5B is a cross-sectional view of the inkjet head shown in FIG. 5A taken along a line I—I of FIG. 5A.
Figure 5C:
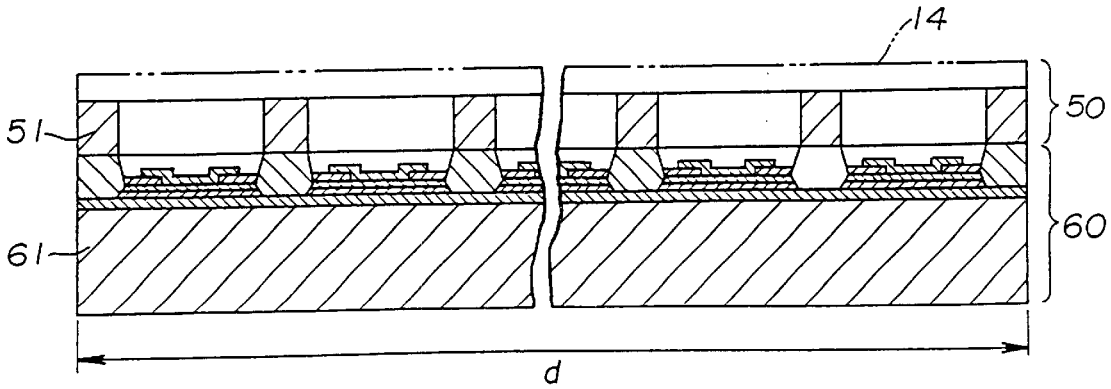
FIG. 5C is a cross-sectional view of the inkjet head shown in FIG. 5A taken along a line II—II of FIG. 5A.

A description will now be given, with reference to FIGS. 5A, 5B and 5C, of a third preferred embodiment of the present invention. FIG. 5A is a plan view of an inkjet head according to the third preferred embodiment of the present invention. FIG. 5B is a cross-sectional view of the inkjet head shown in FIG. 5A taken along a line I—I of FIG. 5A, and FIG. 5C is a cross-sectional view of the inkjet head shown in FIG. 5A taken along a line II—II of FIG. 5A.

The inkjet head according to the present preferred embodiment includes an ink-chamber substrate 50 and an electrode substrate 60. The ink-chamber substrate 40 is preferably made of a single crystal silicon (Si) substrate. A plurality of inkjet nozzles are provided on the ink-chamber substrate 50 preferably via an anisotropic etching method. A plurality of individual ink-chambers are formed inside of the ink-chamber substrate 50 so that each of the inkjet nozzles is provided for a respective one of the individual ink-chambers. A common ink-chamber is also formed inside of the ink-chamber substrate 50. The common ink-chamber is connected to each of the individual ink-chambers by passages formed preferably by an anisotropic etching method so that ink is supplied to each of the individual ink-chambers from the common ink-chamber. A part of a wall constituting each of the individual ink-chambers defines a thin silicon film vibration plate which is driven by an electrostatic force. The thin silicon film vibration plate is located opposite to an individual electrode formed on the electrode substrate 60.

The electrode substrate 60 is also made of a single crystal silicon (Si) substrate 61 which contains n-type or p-type impurity atoms. The single crystal silicon substrate 61 preferably contains impurity atoms of about 1E14/cm$^3$. Normally, a single crystal Si substrate having a plane orientation (100) is used for the substrate 61. However, a single crystal Si substrate having a plane orientation (110) or (111) may preferably be used depending on a processing method to be used. A silicon oxide film 62 is formed on the Si substrate 61, and individual electrodes 63*b* are formed on the silicon oxide film 62 which defines an insulating layer. The individual electrodes 63*b* are made of an n-type or p-type polycrystalline silicon or an n-type or p-type single crystal silicon. The individual electrodes 63*b* contain impurity atoms implanted via an impurity introducing method such as an ion implantation method, a coating diffusion method or a solid diffusion method. The individual electrodes 63*b* preferably contain more than about 1E18/cm$^3$ of impurity atoms. Additionally, a silicide film 67 is formed on the individual electrodes 63*b*. The silicide film 67 is preferably made of titanium silicide. Insulating gap spacers 63*a* are formed on the silicon oxide film 62 so that each of the individual electrodes 63*b* is located inside of a space defined by the insulating gap spacers 63*a*.

The insulating gap spacers 63*a* are made of a silicon (Si) oxidation film formed via a thermal oxidation method. The insulating gap spacers 63*a* define a gap between the vibration plates formed in the ink-chamber substrate 50 and the individual electrodes 63*b* formed in the electrode substrate 60. That is, an electrostatic force is generated between each of the vibration plates and the respective one of the individual electrodes 63*b* separated by the gap defined by the insulating gap spacers 63*a*.

A silicon nitride insulating film 68 is formed on the silicide film 67 of each of the individual electrodes 63*b* so as to maintain insulation between each of the individual electrodes 63*b* and the respective one of the vibration plates formed in the ink-chamber substrate 50. A voltage applying pad 69 is formed on the silicon nitride insulating film 68. A part of the voltage applying pad 69 is connected to the silicide film 67 of each of the individual electrodes 63*b* so as to apply a voltage to the individual electrode 63*b*.

In FIGS. 5A, 5B and 5C, an area indicated by an arrow b is an opening through which a flexible printed circuit board (FPC) or a bonding wire is connected to each of the voltage applying pads 69. Additionally, arrows X and Y shown in FIG. 5B are directions of a droplet of ink projected from each of the inkjet nozzles formed on the ink-chamber substrate 50. That is, when the inkjet nozzles are provided on a side surface of the ink-chamber substrate 50, the droplet of ink is projected in the direction indicated by the arrow X. When the inkjet nozzles are provided on a top surface of the ink-chamber substrate 50, the droplet of ink is projected in the direction indicated by the arrow Y.

Figure 6A:
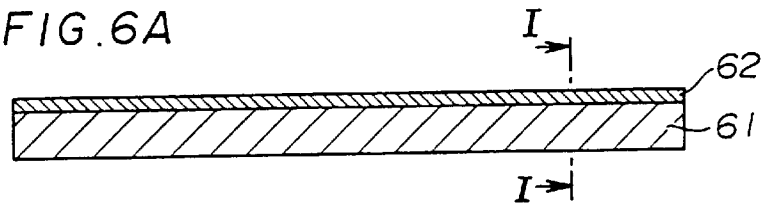

A description will now be given, with reference to FIGS. 6A through 6T, of an example of a method of manufacturing the inkjet head according to the above-mentioned third preferred embodiment shown in FIGS. 5A, 5B and 5C. FIGS. 6A through 6T are cross-sectional views for explaining the manufacturing process of the inkjet head according to the third preferred embodiment of the present invention. It should be noted that FIGS. 6B, 6D, 6F, 6H, 6J, 6L, 6N, 6P, 6R and 6T are cross-sectional views taken along a line I—I of FIGS. 6A, 6C, 6E, 6G, 6I, 6K, 6M, 60, 6Q and 6S, respectively.

Figure 6B:
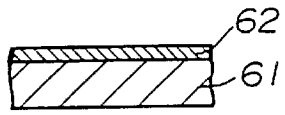

First, as shown in FIGS. 6A and 6B, the insulating film 62 is formed on the single crystal silicon substrate 61 via a thermal oxidation method, a chemical vapor deposition method or a sputtering method. The single crystal silicon substrate 61 is an n-type or a p-type, and preferably has a thickness of about 400 $\mu$m to about 700 $\mu$m and an electrical resistivity of about 5 $\Omega$-cm$^3$ to about 30 $\Omega$–cm$^3$. Plane orientation of the single crystal silicon substrate 61 is (100), (111) or (110). The insulating film 62 provides insulation between the individual electrodes and the single crystal silicon substrate 21.

Figure 6C:
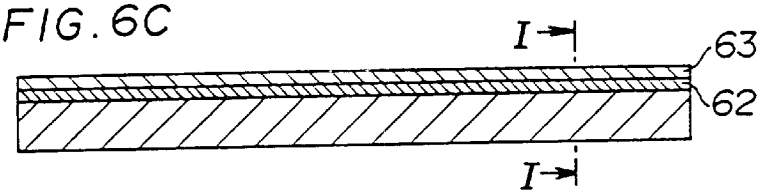
Figure 6D:
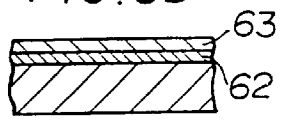

Thereafter, as shown in FIGS. 6C and 6D, a silicon film 63 is formed on the insulating film 22. The silicon film 63 can be formed of an n-type or p-type polycrystalline silicon or an n-type or p-type single crystal silicon. The silicon film 63 preferably contains impurity atoms of about 1E18/cm$^3$ which can be implanted by an impurity introducing method such as an ion implantation method, a coating diffusion method or a solid diffusion method.

Figure 6E:
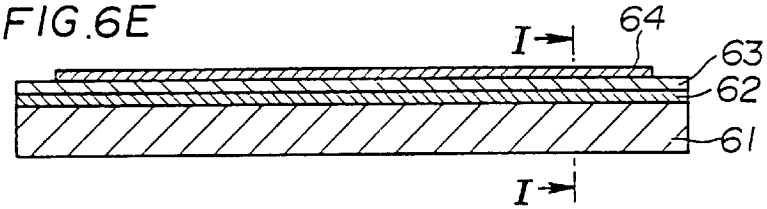
Figure 6F:
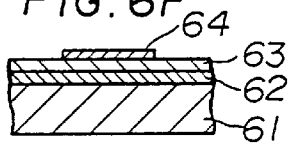

Thereafter, as shown in FIGS. 6E and 6F, the insulating film 64 is formed on the silicon film 63 by a chemical vapor deposition (CVD) method or a sputtering method. The insulating film 64 is preferably made of a silicon nitride film so as to prevent diffusion of oxygen. Then, the insulating film 64 is patterned by a regular photolithography process and a dry or wet etching method so as to form parts corresponding to the individual electrodes 63*b*.

Figure 6G:
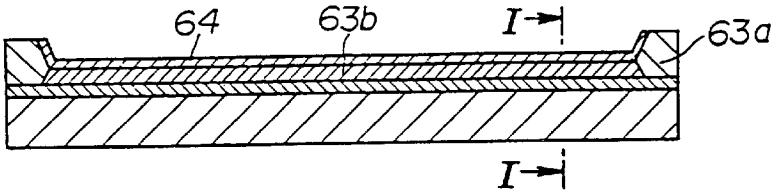
Figure 6H:
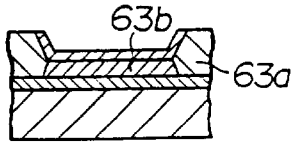
Figure 6I:
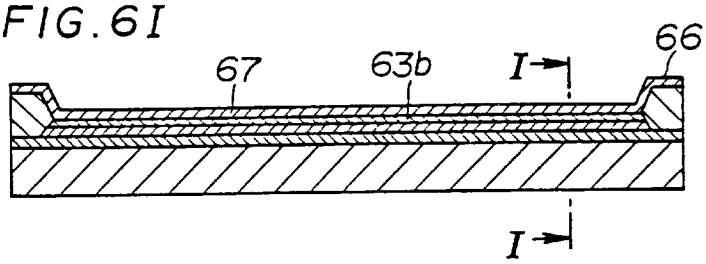
Figure 6J:
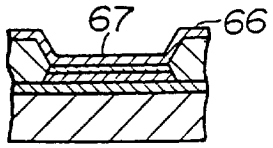

Thereafter, the silicon film 63 is oxidized by being placed in an oxygen atmosphere in an electric furnace. At this time, a first area of the silicon film 23 in which first area, the insulating film 64 for preventing oxygen diffusion is not formed is oxidized. Thus, a thick silicon oxidation film 63*a* is formed as shown in FIGS. 6G and 6H. On the other hand, a second area of the silicon film 63 in which second area the insulating film 64 for preventing oxygen diffusion is formed is not oxidized. Thus, the thickness of the silicon film 63 in the second area remains unchanged as shown in FIGS. 6G and 6H. Since the silicon oxide film 62*a* and the silicon film 63*b* have different thicknesses, a step is formed between the silicon oxide film 63*a* and the silicon film 63*b*. This step corresponds to the gap between the individual electrodes and the vibration plates in the inkjet head according to the present preferred embodiment.

Thereafter, an insulating layer 64 for preventing oxygen diffusion is removed, and a metal film 66 is formed on the silicon films 63*a* and 63*b*. The metal film 66 is preferably made of titanium. After the metal film 66 is formed, annealing is performed within a nitrogen atmosphere by using an RTA apparatus or a furnace. In the annealing process, a silicide reaction occurs in the silicon film 63*b* (corresponding to the individual electrode) since the surface of the silicon film 63*b* is pure silicon. Accordingly, a silicide layer (titanium silicide film) 67 is formed on the silicon film 63*b*. On the other hand, since the silicon film 63*a* is oxidized, a silicide reaction does not occur. Accordingly, a silicide film is not formed on the silicon film 63*a* as shown in FIG. 6M.

Figure 6K:
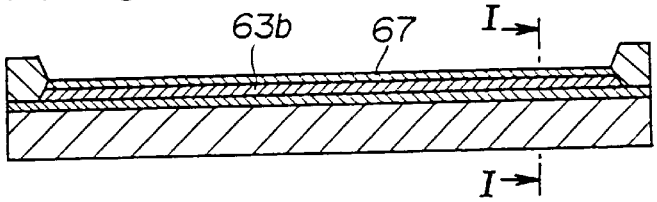
Figure 6L:
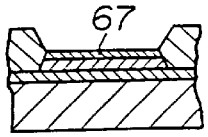
Figure 6M:
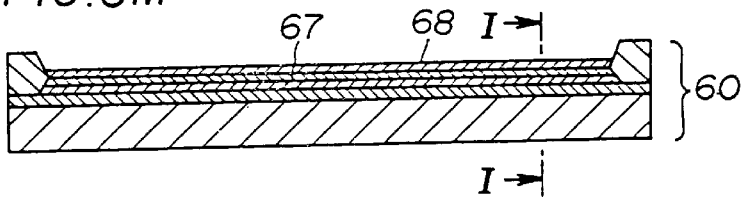

Thereafter, the metal film 66 is removed by wet etching so that the silicide layer 67 remains on the silicon film 63*b* as shown in FIGS. 6K and 6L. When titanium is used as the metal film 66, a mixture of an ammonium solution and a hydrogen peroxide solution is used for removing the metal film 66.

Figure 6N:
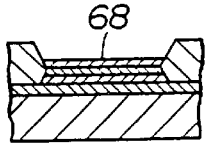

Thereafter, an insulating film such as a silicon nitride film is formed on the entire surface of the electrode substrate 60 via a chemical vapor deposition method or a sputtering method. After that, the insulating film 68 is subjected to a patterning so that the insulating film 68 remains only on the silicide layer 67 as shown in FIGS. 6M and 6N. It should be noted that the insulating film 68 is not necessarily formed.

Figure 6O:
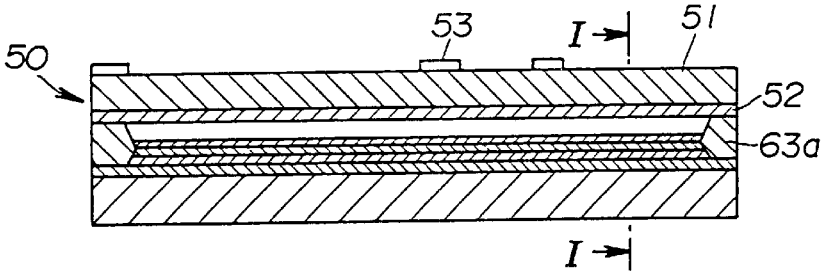
Figure 6P:
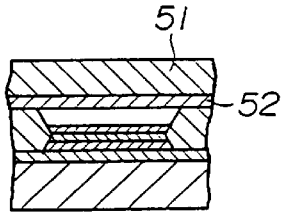

Thereafter, as shown in FIGS. 6O and 6P, a single crystal silicon substrate 51 (corresponding to the ink-chamber substrate 50) is joined to the electrode substrate 60 which is in an intermediate state. The single crystal silicon substrate 51 is an n-type or a p-type, and has a plane orientation (110). A diffusion layer 52 and single crystal silicon etching mask patterns 53 are previously formed on the single crystal silicon substrate 51. The diffusion layer 52 contains n-type or p-type impurities of more than about 1E19/cm$^3$. A thickness of the diffusion layer 52 is preferably substantially equal to a thickness of the vibration plate. The single crystal silicon etching patterns 53 are formed on a surface of the single crystal silicon substrate 51 which surface is opposite to the surface on which the diffusion layer 52 is formed. The etching mask patterns 53 are preferably formed of a silicon oxide film, a silicon nitride film or a tantalum peroxide film. The etching mask patterns 53 are provided so as to define areas in which ink chambers and inkjet nozzles are formed. It should be noted that the substrate 51 can be a silicon on insulator (SOI) substrate which is constituted by a single crystal silicon substrate and a single crystal thin silicon film formed on the single crystal silicon substrate via a silicon oxide film.

The ink-chamber substrate 50 can be joined to the electrode substrate 60 via a direct bonding method or an anode bonding method. In the direct bonding method, the bonding is performed at a temperature of more than about 800° C. within an oxygen atmosphere at a normal pressure or a reduced pressure. In the anode bonding method, an insulating film containing mobile ions such as Na ions or H ions is formed on the single crystal silicon substrate preferably via a sputtering method, and, thereafter, the bonding is performed by applying an electric field at a temperature ranging from about 200° C. to about 500° C., and preferably about 350° C. to about 450° C. Additionally, it is preferable that before the bonding is performed, the silicon oxidation film 63*a* of the electrode substrate 60 is polished via a chemical mechanical polishing process so as to planarize the surface to be bonded.

Figure 6Q:
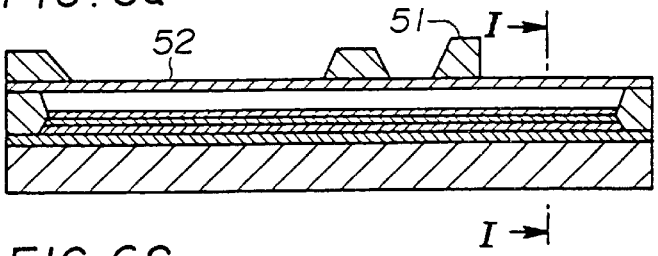
Figure 6R:
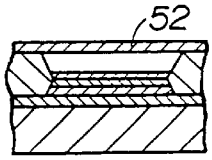

After the ink-chamber substrate 50 is bonded to the electrode substrate 60, the ink-chamber substrate 50 (the single crystal silicon substrate 51) is etched by an anisotropic etching method on the surface provided with the etching mask patterns 53. The anisotropic etching is performed by using KOH or TMAH. The etching is stopped by the diffusion layer 52 which contains impurities at a high concentration. Accordingly, the diffusion layer 52 remains as the vibration plate as shown in FIGS. 6Q and 6R. If the SOI substrate is used, the etching is stopped by the silicon oxide film. In such a case, the silicon oxide film on the SOI substrate may be removed after the etching.

Figure 6S:
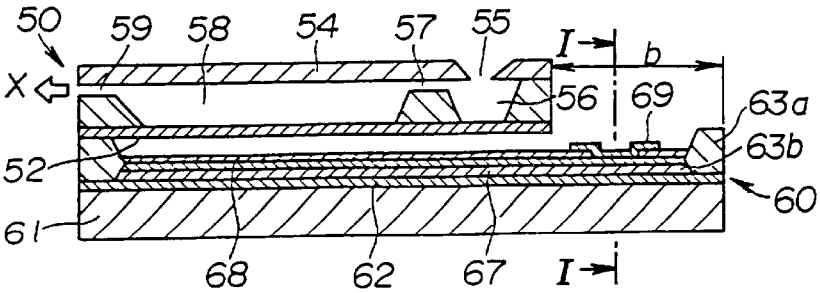
Figure 6T:
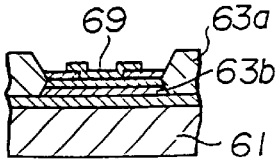

Thereafter, an ink-chamber cover 14 is bonded to the substrate 51 so as to form the individual ink-chambers 58 and the common ink-chamber 56 as shown in FIG. 6S. The ink-chamber cover 54 is preferably formed of a glass plate or a metal plate. A passage 55 for supplying ink to the common ink-chamber 56 is previously formed in the ink-chamber cover 54 preferably via sand blasting or laser machining. Additionally, the crystal silicon thin film 52 corresponding to a pad area (an area indicated by arrow b) is removed by etching. Then, the voltage applying pads 69 are formed on the individual electrodes 63*b*.

As shown in FIG. 6S, each of the inkjet nozzles 59 is provided for a respective one of the individual ink-chambers 58. Each of the individual ink-chambers 58 is connected to the common ink-chamber 55 via the passage 57.

When a predetermined voltage is applied to the voltage applying pad 69 which is connected to the individual electrode 63*b*, an electrostatic force is generated between the vibration plate 52 and the individual electrode 63*b* which results in warpage of the vibration plate 52 toward the individual electrode 63*b*. Accordingly, ink is introduced into the individual ink-chamber 58 via the passage 55, the common ink-chamber 56 and the passage 57. When the supply of the voltage is stopped, the vibration plate 52 returns to the original position due to its elasticity. At this time, the ink in the individual ink-chamber 58 is pressurized, and a droplet of the ink is discharged from the inkjet nozzle 59 in a direction indicated by an arrow X in FIG. 6S so that the droplet of the ink is projected onto a recording paper.

In the present preferred embodiment, although the inkjet nozzle 59 is formed so that a droplet of ink is projected in the direction (horizontal direction) indicated by the arrow X, the droplet of ink may be projected in a vertical direction by changing the position of the inkjet nozzle 59. Additionally, the inkjet nozzle 59 may be formed after the ink-chamber substrate 50 and the electrode substrate 60 are bonded to each other.

Figure 7A:
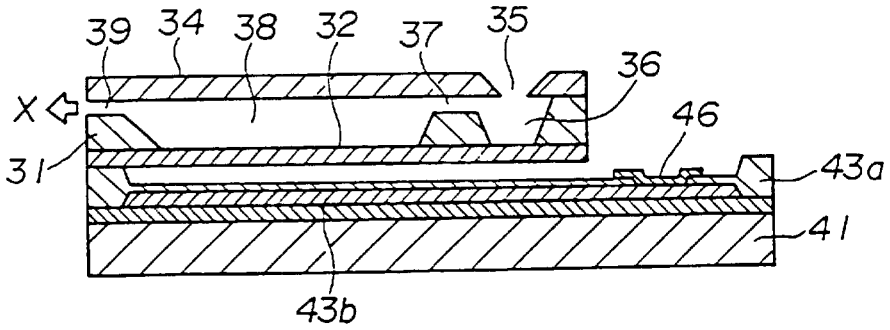
FIG. 7A is a cross-sectional view of a first example of the inkjet head which cross-sectional view corresponds to the cross-sectional view of FIG. 3B.
Figure 7B:
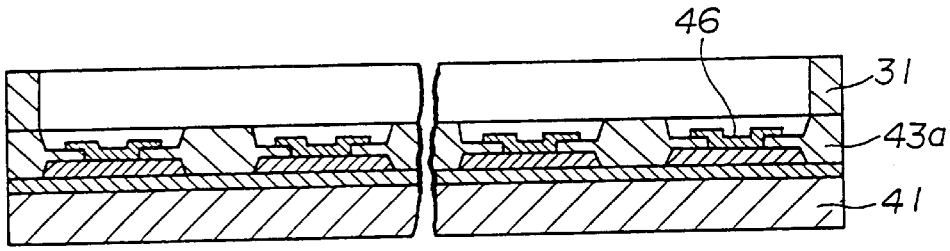
FIG. 7B is a cross-sectional view of the first example of the inkjet head which cross-sectional view corresponds to the cross-sectional view of FIG. 3C.

A description will now be given, with reference to FIGS. 7A and 7B, of a first example of the inkjet head according to preferred embodiments of the present invention. The first example of the inkjet head according to preferred embodiments of the present invention was produced by the manufacturing process shown in FIGS. 4A through 4P. FIG. 7A is a cross-sectional view of the first example of the inkjet head which cross-sectional view corresponds to the cross-sectional view of FIG. 3B. FIG. 7B is a cross-sectional view of the first example of the inkjet head which cross-sectional view corresponds to the cross-sectional view of FIG. 3C.

In the inkjet head shown in FIGS. 7A and 7B, a p-type single crystal silicon substrate having a plane orientation (100) and an electric resistivity of 10 Ω–cm$^3$ was used to form the substrate 41. The insulating film 42 having a thickness of about 300 nm was formed on the silicon substrate 41 by oxidizing a surface of the substrate 41. The individual electrode 43*b* having a thickness of about 500 nm was formed on the insulating film 42. The gap spacers 43*a* which are silicon oxide films were formed by being placed within an $H_2$ and $\mathbf{0}_2$ atmosphere in a pyrogenic oxidation furnace. The thickness of the silicon oxidation film formed on the individual electrode 43*b* is preferably about 200 nm. The gap between the vibration plate 32 and the individual electrode 43*b* is preferably about 0.5 μm. The individual electrode 43*b* was formed by n-type polycrystalline silicon. Phosphorus atoms were implanted into the n-type polycrystalline silicon by an ion implantation method so that the impurity concentration becomes about 1E20/cm$^3$. The voltage applying pad 46 was formed by using gold (Au) via a sputtering method.

The vibration plate 32 was formed by etching the single crystal silicon substrate 31 having a plane orientation (110) via an anisotropic etching method using KOH. The vibration plate 32 contained boron impurity atoms at a concentration of more than about 1E20/cm$^3$. The thickness of the vibration plate 32 was about 3 μm. The vibration plate 32 was bonded to the gap spacers 43*a* (silicon oxide film) via a direct bonding method. The individual ink-chamber 38 and the common ink-chamber 36 were formed in the single crystal silicon substrate 31 via an anisotropic etching method using KOH. The passage 37 was also formed between the individual ink-chamber 38 and the common ink-chamber 36. Additionally, the ink-chamber cover 34 was made of a glass plate. The ink-chamber cover 34 had the passage 35 for supplying ink which passage 35 was formed by a sand blasting process. The thus-formed ink-chamber cover 34 was bonded to the single crystal silicon substrate 31.

The vibration plate 32 of the thus-formed inkjet head was grounded and a predetermined positive voltage was applied to the individual electrode 43*b* via the voltage applying pad 46 at a predetermined frequency. When the voltage is applied, an electrostatic force was generated between the vibration plate 32 and the individual electrode 43*b*. As a result, the vibration plate 32 was attracted toward the individual electrode 32. Accordingly, a negative pressure was generated in the individual ink-chamber 38, and ink was supplied from the common ink-chamber 36 to the individual ink-chamber 38. When the voltage applied to the individual electrode 43*b* was cut, the vibration plate 32 returned to its original position, and, thus, the ink in the individual ink-chamber 38 was pressurized. Thereby, a droplet of the ink was discharged from the inkjet nozzle 39 in a direction indicated by an arrow X, and landed on a recording paper.

Figure 8A:
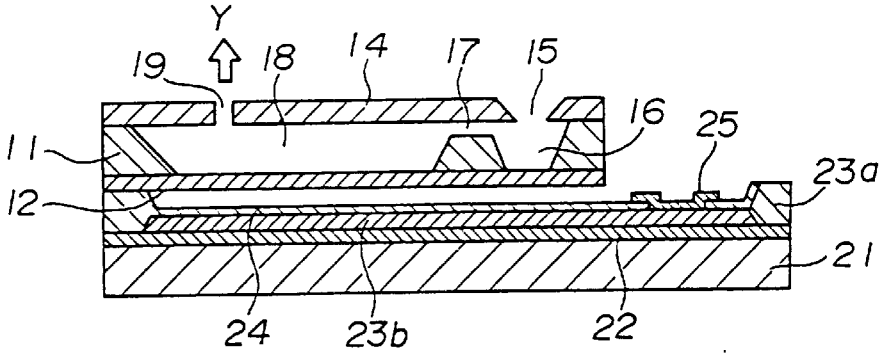
FIG. 8A is a cross-sectional view of a second example of the inkjet head which cross-sectional view corresponds to the cross-sectional view of FIG. 1B.
Figure 8B:
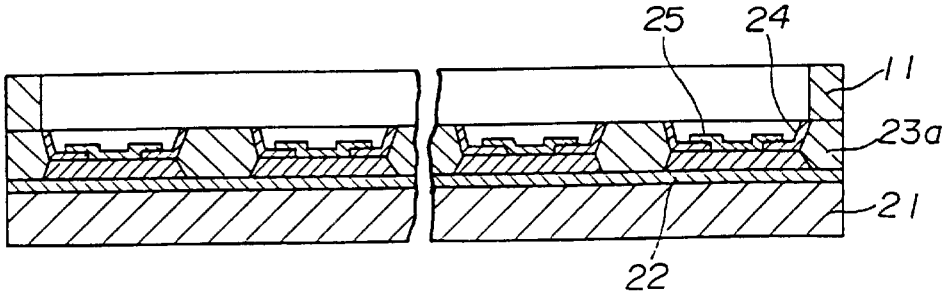
FIG. 8B is a cross-sectional view of the second example of the inkjet head which cross-sectional view corresponds to the cross-sectional view of FIG. 1C.

A description will now be given, with reference to FIGS. 8A and 8B, of a second example of the inkjet head according to preferred embodiments of the present invention. The second example of the inkjet head according to preferred embodiments of the present invention was produced by the manufacturing process shown in FIGS. 2A through 2N. FIG. 8A is a cross-sectional view of the second example of the inkjet head which cross-sectional view corresponds to the cross-sectional view of FIG. 1B. FIG. 8B is a cross-sectional view of the second example of the inkjet head which cross-sectional view corresponds to the cross-sectional view of FIG. 1C.

In the inkjet head shown in FIGS. 8A and 8B, a p-type single crystal silicon substrate having a plane orientation (100) and an electric resistivity of about 10 Ω-cm$^3$ was used to form the substrate 21. The insulating film 22 having a thickness of about 300 nm was formed on the silicon substrate 21 by oxidizing the silicon substrate 21. The individual electrode 23*b* was formed on the insulating film 22. The gap spacers 23*a* which are silicon oxide films were formed by being placed within an $H_2$ and $\mathbf{0}_2$ atmosphere in a pyrogenic oxidation furnace. The gap between the vibration plate 12 and the individual electrode 23*b* was about 0.5 μm. The individual electrode 23*b* having a thickness of about 500 nm was formed of p-type polycrystalline silicon. Boron atoms were implanted into the p-type polycrystalline silicon via an ion implantation method so that the impurity concentration becomes about 1E20/cm$^3$. The silicon nitride film 24 having a thickness of about 100 nm was formed on the individual electrode 23*b* by an LPCVD method. The voltage applying pad 25 was formed by using gold (Au) via a sputtering method.

The vibration plate 12 was formed by etching the single crystal silicon substrate 11 having a plane orientation (110) by an anisotropic etching method using KOH. The vibration plate 12 contained phosphorus impurity atoms at a concentration of more than about 1E20/cm$^3$. The thickness of the vibration plate 12 was about 3 μm. The vibration plate 12 was bonded to the gap spacers 23*a* (silicon oxide film) by a direct bonding method. The individual ink-chamber 18 and the common ink-chamber 16 were formed in the single crystal silicon substrate 11 via an anisotropic etching method using KOH. The passage 17 was also formed between the individual ink-chamber 18 and the common ink-chamber 16. Additionally, the ink-chamber cover 14 was formed by a glass plate. The ink-chamber cover 14 had the passage 15 for supplying ink which passage 15 was formed by a sand blasting. The thus-formed ink-chamber cover 14 was bonded to the single crystal silicon substrate 11.

The vibration plate 12 of the thus-formed inkjet head was grounded and a predetermined positive voltage was applied to the individual electrode 23*b* via the voltage applying pad 25 at a predetermined frequency. When the voltage is applied, an electrostatic force was generated between the vibration plate 12 and the individual electrode 23*b*. Thereby, the vibration plate 12 was attracted toward the individual electrode 23*b*. Accordingly, a negative pressure was generated in the individual ink-chamber 18, and ink was supplied from the common ink-chamber 16 to the individual ink-chamber 18. When the voltage applied to the individual electrode 23*b* was cut, the vibration plate 12 returned to its original position, and, thus, the ink in the individual ink-chamber 18 was pressurized. Thereby, a droplet of the ink was ejected from the inkjet nozzle 19 in a direction indicated by an arrow X, and landed on a recording paper.

Figure 9A:
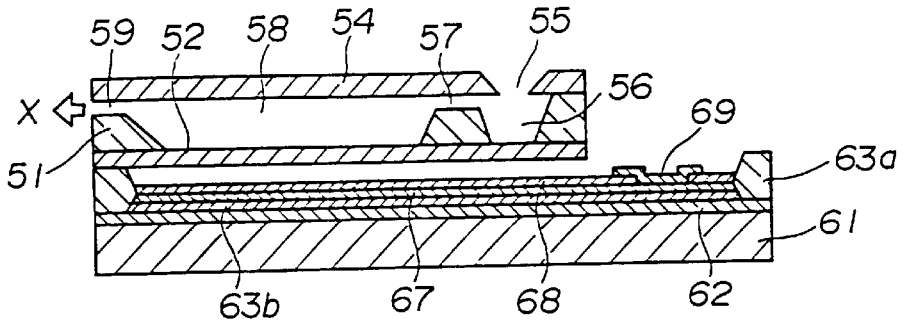
FIG. 9A is a cross-sectional view of a third example of the inkjet head which cross-sectional view corresponds to the cross-sectional view of FIG. 5B.
Figure 9B:
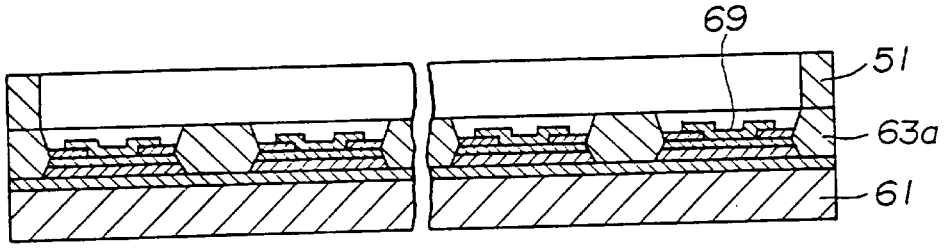
FIG. 9B is a cross-sectional view of the third example of the inkjet head which cross-sectional view corresponds to the cross-sectional view of FIG. 5C.

A description will now be given, with reference to FIGS. 9A and 9B, of a third example of the inkjet head according to preferred embodiments of the present invention. The third example of the inkjet head according to preferred embodiments of the present invention was produced by the manufacturing process shown in FIGS. 6A through 6T. FIG. 9A is a cross-sectional view of the third example of the inkjet head which cross-sectional view corresponds to the cross-sectional view of FIG. 5B. FIG. 9B is a cross-sectional view of the third example of the inkjet head which cross-sectional view corresponds to the cross-sectional view of FIG. 5C.

In the inkjet head shown in FIGS. 9A and 9B, a p-type single crystal silicon substrate having a plane orientation (100) and an electric resistivity of about 10 Ω-cm$^3$ to about 20 Ω-cm$^3$ was used to form the substrate 61. The insulating film 62 having a thickness of about 300 nm was formed on the silicon substrate 61 by oxidizing the silicon substrate 61. The individual electrode 63*b* was formed on the insulating film 62. The gap spacers 63*a* which are silicon oxide films were formed by being placed within an $H_2$ and $\mathbf{0}_2$ atmosphere in a pyrogenic oxidation furnace. The gap between the vibration plate 52 and the individual electrode 63*b* was about 0.5 μm. The individual electrode 63*b* was formed by a p-type or n-type polycrystalline silicon which does not contain impurity atoms. The titanium silicide film 67 having a thickness of about 60 nm was formed on the individual electrode 63*b*. The titanium silicide film 67 defined a part of the individual electrode 63*b*. Additionally, the silicon oxide film 68 having a thickness of about 100 nm was formed on the titanium silicide film 67 by an LPCVD method. The voltage applying pad 69 was formed by using gold (Au) by a sputtering method.

The vibration plate 52 was formed by etching the single crystal silicon substrate 51 having a plane orientation (110) via an anisotropic etching method using KOH. The vibration plate 52 contained phosphorus impurity atoms at a concentration of more than about 1E20/cm$^3$. The thickness of the vibration plate 52 was about 3 μm. The vibration plate 52 was bonded to the gap spacers 63*a* (silicon oxide film) by an anode bonding method which uses an electric field. The individual ink-chamber 58 and the common ink-chamber 56 were formed in the single crystal silicon substrate 51 by an anisotropic etching method using KOH. The passage 57 was also formed between the individual ink-chamber 58 and the common ink-chamber 56. Additionally, the ink-chamber cover 54 was formed of a glass plate. The ink-chamber cover 54 had the passage 55 for supplying ink which passage 55 was formed via sand blasting. The thus-formed ink-chamber cover 54 was bonded to the single crystal silicon substrate 51.

The vibration plate 52 of the thus-formed inkjet head was grounded and a predetermined positive voltage was applied to the individual electrode 63*b* via the voltage applying pad 65 at a predetermined frequency. When the voltage was applied, an electrostatic force was generated between the vibration plate 52 and the individual electrode 63*b*. Thereby, the vibration plate 52 was attracted toward the individual electrode 63*b*. Accordingly, a negative pressure was generated in the individual ink-chamber 58, and ink was supplied from the common ink-chamber 56 to the individual ink-chamber 58. When the voltage applied to the individual electrode 63*b* was cut, the vibration plate 52 returned to its original position, and, thus, the ink in the individual ink-chamber 58 was pressurized. Thereby, a droplet of the ink was ejected from the inkjet nozzle 59 in a direction indicated by an arrow X, and landed on a recording paper.

Figure 10A:
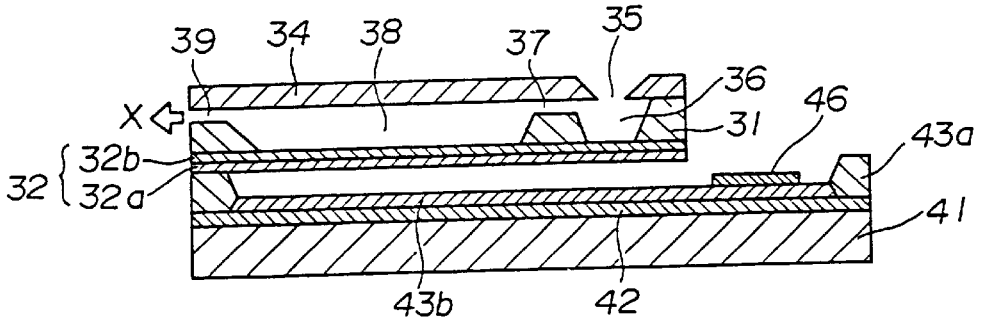
FIG. 10A is a cross-sectional view of a fourth example of the inkjet head which cross-sectional view corresponds to the cross-sectional view of FIG. 3B.
Figure 10B:
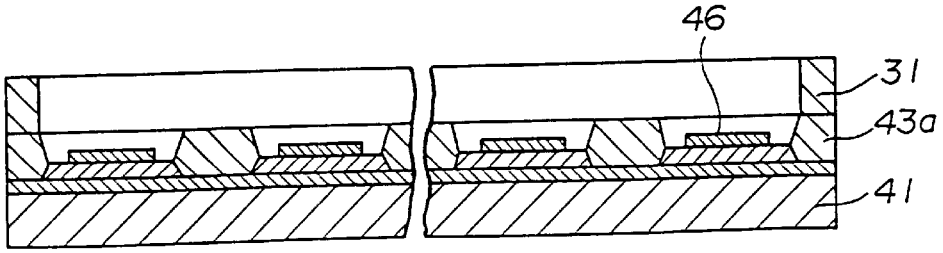
FIG. 10B is a cross-sectional view of the fourth example of the inkjet head which cross-sectional view corresponds to the cross-sectional view of FIG. 3C.

A description will now be given, with reference to FIGS. 10A and 10B, of a fourth example of the inkjet head according to preferred embodiments of the present invention. The fourth example of the inkjet head according to preferred embodiments of the present invention was produced by the manufacturing process shown in FIGS. 4A through 4P. FIG. 10A is a cross-sectional view of the fourth example of the inkjet head which cross-sectional view corresponds to the cross-sectional view of FIG. 3B. FIG. 10B is a cross-sectional view of the fourth example of the inkjet head which cross-sectional view corresponds to the cross-sectional view of FIG. 3C.

In the inkjet head shown in FIGS. 10A and 10B, a p-type single crystal silicon substrate having a plane orientation (100) and an electric resistivity of about 10 Ω-cm$^3$ to about 20 Ω-cm$^3$ was used to form the substrate 41. The insulating film 42 having a thickness of about 300 nm was formed on the silicon substrate 41 by oxidizing a surface of the substrate 41. The individual electrode 43*b* having a thickness of about 300 nm was formed on the insulating film 42. The gap spacers 43*a* which are silicon oxide films were formed by being placed in an $H_2$ and $\mathbf{0}_2$ atmosphere in a pyrogenic oxidation furnace. The gap between the vibration plate 32 and the individual electrode 43*b* was about 0.5 μm The individual electrode 43*b* was formed by p-type polycrystalline silicon. Phosphorus atoms were implanted into the p-type polycrystalline silicon by an ion implantation method so that the impurity concentration becomes 1E20/cm$^3$. A silicon oxide film was not formed on the individual electrode 43*b*. The voltage applying pad 46 was formed by using gold (Au) via a sputtering method.

The vibration plate 32 was formed by etching the single crystal silicon substrate 31 having a plane orientation (110) via an anisotropic etching method using KOH. In the vibration plate 32, a silicon oxide film 32*a* having a thickness of about 3 $\mu$m was formed on the single crystal vibration plate 32*b* having a thickness of about 150 nm. The silicon oxide film 32*a* of the vibration plate 32 was bonded to the gap spacers 43*a* (silicon oxide film) via a direct bonding method. The individual ink-chamber 38 and the common ink-chamber 36 were formed in the single crystal silicon substrate 31 by an anisotropic etching method using KOH. The passage 37 was also formed between the individual ink-chamber 38 and the common ink-chamber 36. Additionally, the ink-chamber cover 34 was formed of a glass plate. The ink-chamber cover 34 included the passage 35 for supplying ink which passage 35 was formed by sand blasting. The thus-formed ink-chamber cover 34 was bonded to the single crystal silicon substrate 31.

The vibration plate 32 of the thus-formed inkjet head was grounded and a predetermined positive voltage was applied to the individual electrode 43*b* via the voltage applying pad 46 at a predetermined frequency. When the voltage was applied, an electrostatic force was generated between the vibration plate 32 and the individual electrode 43*b*. Thereby, the vibration plate 32 was attracted toward the individual electrode 32. Accordingly, a negative pressure was generated in the individual ink-chamber 38, and ink was supplied from the common ink-chamber 36 to the individual ink-chamber 38. When the voltage applied to the individual electrode 43*b* was cut, the vibration plate 32 returned to its original position, and, thus, the ink in the individual ink-chamber 38 was pressurized. As a result, a droplet of the ink was ejected from the inkjet nozzle 39 in a direction indicated by an arrow X, and landed on a recording paper.

Figure 11A:
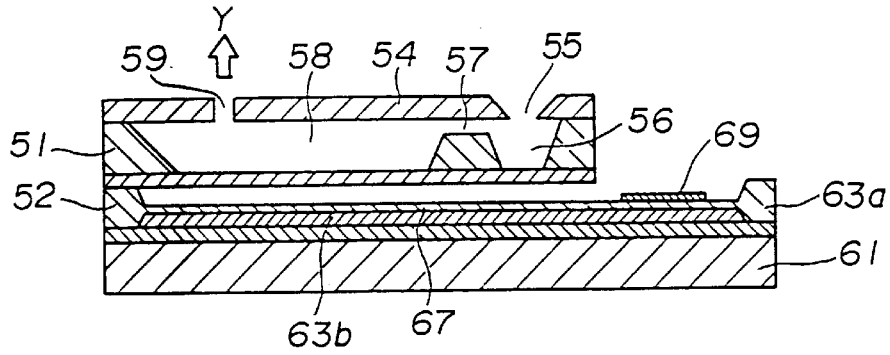
FIG. 11A is a cross-sectional view of a fifth example of the inkjet head which cross-sectional view corresponds to the cross-sectional view of FIG. 5B.
Figure 11B:
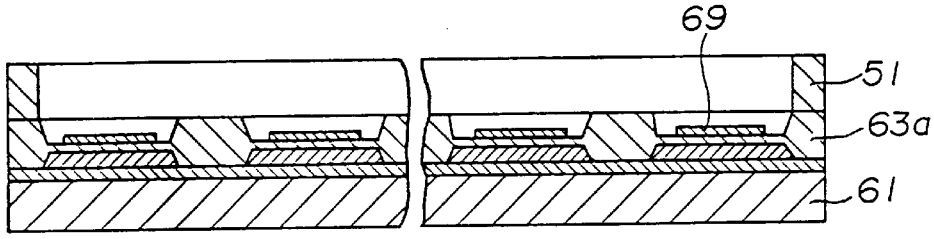
FIG. 11B is a cross-sectional view of the fifth example of the inkjet head which cross-sectional view corresponds to the cross-sectional view of FIG. 5C.

A description will now be given, with reference to FIGS. 11A and 11B, of a fifth example of the inkjet head according to preferred embodiments of the present invention. The fifth example of the inkjet head according to preferred embodiments of the present invention was produced by the manufacturing process shown in FIGS. 6A through 6T. FIG. 11A is a cross-sectional view of the fifth example of the inkjet head which cross-sectional view corresponds to the cross-sectional view of FIG. 5B. FIG. 11B is a cross-sectional view of the fifth example of the inkjet head which cross-sectional view corresponds to the cross-sectional view of FIG. 5C.

In the inkjet head shown in FIGS. 11A and 11B, a p-type single crystal silicon substrate having a plane orientation (100) and an electric resistivity of about 10 Ω-cm$^3$ to about 20 Ω-cm$^3$ was used to form the substrate 61. The insulating film 62 having a thickness of about 300 nm was formed on the silicon substrate 61 by oxidizing the silicon substrate 61. The individual electrode 63*b* was formed on the insulating film 62. The gap spacers 63*a* which are silicon oxide films were formed by being placed within an $H_2$ and $\mathbf{0}_2$ atmosphere in a pyrogenic oxidation furnace. The gap between the vibration plate 52 and the individual electrode 63*b* was about 0.5 $\mu$m. The individual electrode 63*b* was formed by an n-type single crystal silicon containing phosphorus atoms at an impurity concentration of more than about 1E20/cm$^3$. The phosphorus atoms were implanted by an ion implantation method. The titanium silicide film 67 having a thickness of about 100 nm was formed on the individual electrode 63*b*. The titanium silicide film 67 served as a part of the individual electrode 63*b*. A silicon oxide film serving as a protective film was not formed on the titanium silicide film 67. The voltage applying pad 69 was formed by using gold (Au) via a sputtering method.

The vibration plate 52 was formed by etching the single crystal silicon substrate 51 having a plane orientation (110) via an anisotropic etching method using KOH. The vibration plate 52 contained boron impurity atoms at a concentration of more than about 1E20/cm$^3$. The thickness of the vibration plate 52 was about 3 $\mu$m. The vibration plate 52 was bonded to the gap spacers 63*a* (silicon oxide film) via a direct bonding method. The individual ink-chamber 58 and the common ink-chamber 56 were formed in the single crystal silicon substrate 51 via an anisotropic etching method using KOH. The passage 57 was also formed between the individual ink-chamber 58 and the common ink-chamber 56. Additionally, the ink-chamber cover 54 was formed of a glass plate. The ink-chamber cover 54 had the passage 55 for supplying ink which passage 55 was formed by sand blasting. The thus-formed ink-chamber cover 54 was bonded to the single crystal silicon substrate 51.

The vibration plate 52 of the thus-formed inkjet head was grounded and a predetermined positive voltage was applied to the individual electrode 63*b* via the voltage applying pad 65 at a predetermined frequency. When the voltage was applied, an electrostatic force was generated between the vibration plate 52 and the individual electrode 63*b*. Thereby, the vibration plate 52 was attracted toward the individual electrode 63*b*. Accordingly, a negative pressure was generated in the individual ink-chamber 58, and ink was supplied from the common ink-chamber 56 to the individual ink-chamber 58. When the voltage applied to the individual electrode 63*b* was cut, the vibration plate 52 returned to its original position, and, thus, the ink in the individual ink-chamber 58 was pressurized. Thereby, a droplet of the ink was ejected from the inkjet nozzle 59 in a direction indicated by an arrow Y, and landed on a recording paper.

Figure 12A:
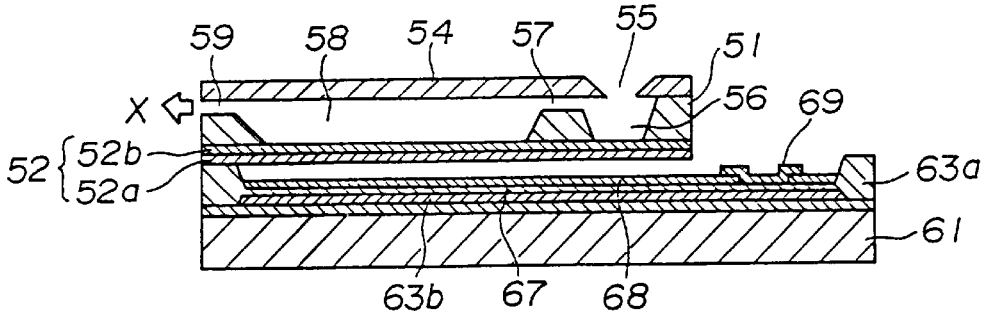
FIG. 12A is a cross-sectional view of a sixth example of the inkjet head which cross-sectional view corresponds to the cross-sectional view of FIG. 5B.
Figure 12B:
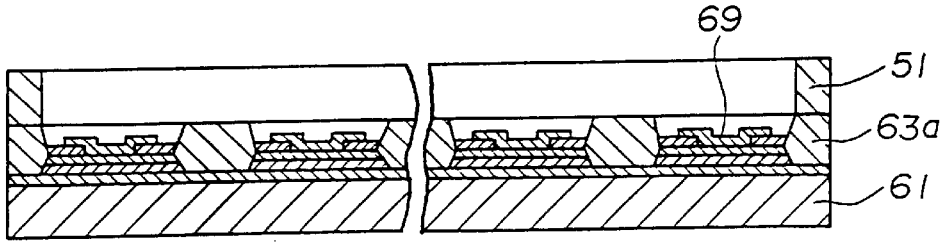
FIG. 12B is a cross-sectional view of the sixth example of the inkjet head which cross-sectional view corresponds to the cross-sectional view of FIG. 5C.

A description will now be given, with reference to FIGS. 12A and 12B, of a sixth example of the inkjet head according to preferred embodiments of the present invention. The sixth example of the inkjet head according to preferred embodiments of the present invention was produced by the manufacturing process shown in FIGS. 6A through 6T. FIG. 12A is a cross-sectional view of the sixth example of the inkjet head which cross-sectional view corresponds to the cross-sectional view of FIG. 5B. FIG. 12B is a cross-sectional view of the sixth example of the inkjet head which cross-sectional view corresponds to the cross-sectional view of FIG. 5C.

In the inkjet head shown in FIGS. 12A and 12B, a p-type single crystal silicon substrate having a plane orientation (100) and an electric resistivity of about 10 Ω-cm$^3$ to about 20 Ω-cm$^3$ was used to form the substrate 61. The insulating film 62 having a thickness of about 300 nm was formed on the silicon substrate 61 by oxidizing the silicon substrate 61. The individual electrode 63*b* was formed on the insulating film 62. The gap spacers 63*a* which are silicon oxide films were formed by being placed within an $H_2$ and $\mathbf{0}_2$ atmosphere in a pyrogenic oxidation furnace. The gap between the vibration plate 52 and the individual electrode 63*b* was about 0.5 $\mu$m. The individual electrode 63*b* was formed by a p-type or n-type single crystal silicon which does not contain impurity atoms. The titanium silicide film 67 having a thickness of about 50 nm was formed on the individual electrode 63*b*. The titanium silicide film 67 defined a part of the individual electrode 63*b*. Additionally, the silicon nitride film 68 having a thickness of about 150 nm was formed on the titanium silicide film 67 by an LPCVD method. The voltage applying pad 69 was formed by using gold (Au) via a sputtering method.

The vibration plate 52 was formed by etching the single crystal silicon substrate 51 having a plane orientation (110) via an anisotropic etching method using KOH. The vibration plate 52 contained phosphorus impurity atoms at a concentration of more than about 1E20/cm$^3$. The thickness of the vibration plate 52 was about 3 $\mu$m. The vibration plate 52 was bonded to the gap spacers 63*a* (silicon oxide film) by an anode bonding method which uses an electric field. The individual ink-chamber 58 and the common ink-chamber 56 were formed in the single crystal silicon substrate 51 by an anisotropic etching method using KOH. The vibration plate 52 included a single crystal silicon film 52*a* having a thickness of about 2 $\mu$m and a silicon oxide film 52*b* having a thickness of about 150 nm. The vibration plate was formed by etching the single crystal silicon substrate 51 by an anisotropic etching method. The passage 57 was also formed between the individual ink-chamber 58 and the common ink-chamber 56. Additionally, the ink-chamber cover 54 was formed of a glass plate. The ink-chamber cover 54 had the passage 55 for supplying ink which passage 55 was formed by sand blasting. The thus-formed ink-chamber cover 54 was bonded to the single crystal silicon substrate 51.

The vibration plate 52 of the thus-formed inkjet head was grounded and a predetermined positive voltage was applied to the individual electrode 63*b* via the voltage applying pad 65 at a predetermined frequency. When the voltage is applied, an electrostatic force was generated between the vibration plate 52 and the individual electrode 63*b*. Thereby, the vibration plate 52 was attracted toward the individual electrode 63*b*. Accordingly, a negative pressure was generated in the individual ink-chamber 58, and ink was supplied from the common ink-chamber 56 to the individual ink-chamber 58. When the voltage applied to the individual electrode 63*b* was cut, the vibration plate 52 returned to its original position, and, thus, the ink in the individual ink-chamber 58 was pressurized. Thereby, a droplet of the ink was ejected from the inkjet nozzle 59 in a direction indicated by an arrow X, and landed on a recording paper.

Figure 13A:
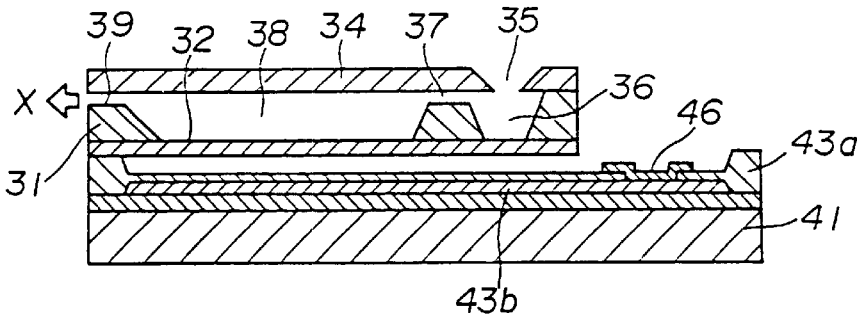
FIG. 13A is a cross-sectional view of a seventh example of the inkjet head which cross-sectional view corresponds to the cross-sectional view of FIG. 3B.
Figure 13B:
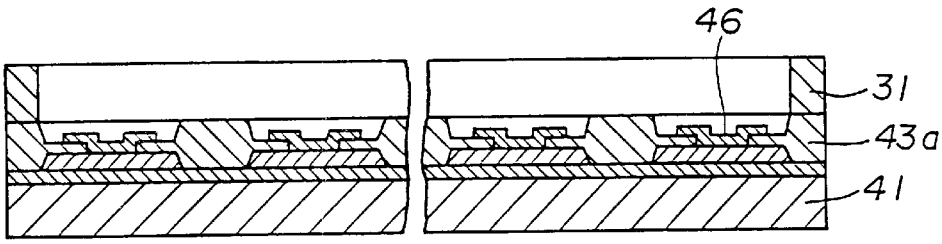
FIG. 13B is a cross-sectional view of the seventh example of the inkjet head which cross-sectional view corresponds to the cross-sectional view of FIG. 3C.

A description will now be given, with reference to FIGS. 13A and 13B, of a seventh example of the inkjet head according to preferred embodiments of the present invention. The seventh example of the inkjet head according to preferred embodiments of the present invention was produced by the manufacturing process shown in FIGS. 4A through 4P. FIG. 13A is a cross-sectional view of the seventh example of the inkjet head which cross-sectional view corresponds to the cross-sectional view of FIG. 3B. FIG. 13B is a cross-sectional view of the seventh example of the inkjet head which cross-sectional view corresponds to the cross-sectional view of FIG. 3C.

In the inkjet head shown in FIGS. 13A and 13B, an n-type single crystal silicon substrate having a plane orientation (100) and an electric resistivity of about 10 Ω-cm$^3$ to about 20 Ω-cm$^3$ was used to form the substrate 41. The insulating film 42 having a thickness of about 300 nm was formed on the silicon substrate 41 by oxidizing a surface of the substrate 41. The individual electrode 43*b* having a thickness of about 300 nm was formed on the insulating film 42. The gap spacers 43*a* which are silicon oxide films were formed by being placed in an $H_2$ and $\mathbf{0}_2$ atmosphere in a pyrogenic oxidation furnace. The thickness of the silicon oxide film formed on the individual electrode 43*b* was about 200 nm. The gap between the vibration plate 32 and the individual electrode 43*b* was about 0.5 $\mu$m. The individual electrode 43*b* was formed by n-type polycrystalline silicon. Phosphorus atoms were implanted into the n-type polycrystalline silicon by an ion implantation method so that the impurity concentration becomes about 1E20/cm$^3$. The voltage applying pad 46 was formed by using gold (Au) via a sputtering method.

The vibration plate 32 was formed by etching the single crystal silicon substrate 31 having a plane orientation (110) by an anisotropic etching method using KOH. The vibration plate 32 contained boron impurity atoms at a concentration of more than about 1E20/cm$^3$. The thickness of the vibration plate 32 was about 2 $\mu$m. The vibration plate 32 was bonded to the gap spacers 43*a* (silicon oxide film) by a direct bonding method. The individual ink-chamber 38 and the common ink-chamber 36 were formed in the single crystal silicon substrate 31 by an anisotropic etching method using KOH. The passage 37 was also formed between the individual ink-chamber 38 and the common ink-chamber 36. Additionally, the ink-chamber cover 34 was formed of a glass plate. The ink-chamber cover 34 had the passage 35 for supplying ink which passage 35 was formed by sand blasting. The thus-formed ink-chamber cover 34 was bonded to the single crystal silicon substrate 31.

The vibration plate 32 of the thus-formed inkjet head was grounded and a predetermined positive voltage was applied to the individual electrode 43*b* via the voltage applying pad 46 at a predetermined frequency. When the voltage was applied, an electrostatic force was generated between the vibration plate 32 and the individual electrode 43*b*. Thereby, the vibration plate was attracted toward the individual electrode 32. Accordingly, a negative pressure was generated in the individual ink-chamber 38, and ink was supplied from the common ink-chamber 36 to the individual ink-chamber 38. When the voltage applied to the individual electrode 43*b* was cut, the vibration plate 32 returned to its original position, and, thus, the ink in the individual ink-chamber 38 was pressurized. Thereby, a droplet of the ink was discharged from the inkjet nozzle 39 in a direction indicated by an arrow X, and landed on a recording paper.

Figure 14A:
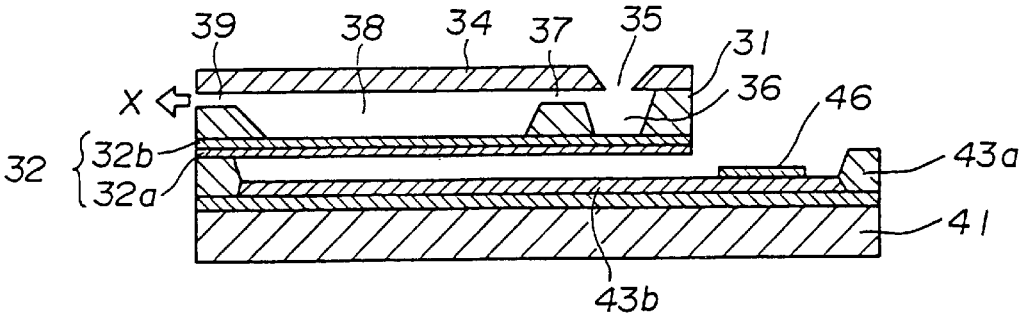
FIG. 14A is a cross-sectional view of an eighth example of the inkjet head which cross-sectional view corresponds to the cross-sectional view of FIG. 3B.
Figure 14B:
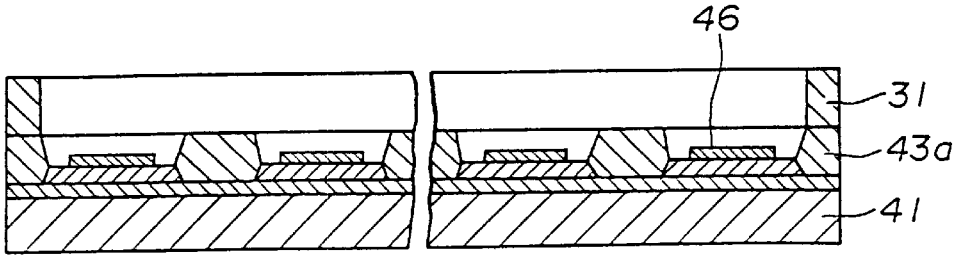
FIG. 14B is a cross-sectional view of the eighth example of the inkjet head which cross-sectional view corresponds to the cross-sectional view of FIG. 3C.

A description will now be given, with reference to FIGS. 14A and 14B, of an eighth example of the inkjet head according to preferred embodiments of the present invention. The eighth example of the inkjet head according to preferred embodiments of the present invention was produced by the manufacturing process shown in FIGS. 4A through 4P. FIG. 14A is a cross-sectional view of the eighth example of the inkjet head which cross-sectional view corresponds to the cross-sectional view of FIG. 3B. FIG. 14B is a cross-sectional view of the eighth example of the inkjet head which cross-sectional view corresponds to the cross-sectional view of FIG. 3C.

In the inkjet head shown in FIGS. 14A and 14B, a p-type single crystal silicon substrate having a plane orientation (100) and an electric resistivity of about 10 Ω-cm$^3$ was used to form the substrate 41. The insulating film 42 having a thickness of about 300 nm was formed on the silicon substrate 41 by oxidizing a surface of the substrate 41. The individual electrode 43*b* having a thickness of about 300 nm was formed on the insulating film 42. The gap spacers 43*a* which are silicon oxide films were formed by being placed in an $H_2$ and $\mathbf{0}_2$ atmosphere in a pyrogenic oxidation furnace. The thickness of the silicon oxide film formed on the individual electrode 43*b* was about 200 nm. The gap between the vibration plate 32 and the individual electrode 43*b* was about 0.5 μm. The individual electrode 43*b* was formed by p-type amorphous silicon. Boron atoms were implanted into the p-type amorphous silicon by an ion implantation method so that the impurity concentration becomes about 1E20/cm$^3$. A silicon oxide film serving as a protective film was not formed on the individual electrode 43*b*. The voltage applying pad 46 was formed by using gold (Au) via a sputtering method.

The vibration plate 32 was formed by etching the single crystal silicon substrate 31 having a plane orientation (110) by an anisotropic etching method using KOH. The vibration plate 32 included a silicon oxide film 32*b* having a thickness of about 150 nm and a single crystal silicon film having a thickness of about 2 μm. The vibration plate 32 was bonded to the gap spacers 43*a* (silicon oxide film) by an anode bonding method in which the bonding is performed by applying a static electric field. The individual ink-chamber 38 and the common ink-chamber 36 were formed in the single crystal silicon substrate 31 by an anisotropic etching method using KOH. The passage 37 was also formed between the individual ink-chamber 38 and the common ink-chamber 36. Additionally, the ink-chamber cover 34 was formed by a glass plate. The ink-chamber cover 34 had the passage 35 for supplying ink which passage 35 was formed by a sand blasting. The thus-formed ink-chamber cover 34 was bonded to the single crystal silicon substrate 31.

The vibration plate 32 of the thus-formed inkjet head was grounded and a predetermined positive voltage was applied to the individual electrode 43*b* via the voltage applying pad 46 at a predetermined frequency. When the voltage is applied, an electrostatic force was generated between the vibration plate 32 and the individual electrode 43*b*. Thereby, the vibration plate 32 was attracted toward the individual electrode 32. Accordingly, a negative pressure was generated in the individual ink-chamber 38, and ink was supplied from the common ink-chamber 36 to the individual ink-chamber 38. When the voltage applied to the individual electrode 43*b* was cut, the vibration plate 32 returned to its original position, and, thus, the ink in the individual ink-chamber 38 was pressurized. Thereby, a droplet of the ink was discharged from the inkjet nozzle 39 in a direction indicated by an arrow X, and landed on a recording paper.

The present invention is not limited to the specifically disclosed preferred embodiments, and variations and modifications may be made without departing from the scope of the present invention.

The present application is based on Japanese priority application No. 10-220541 filed on Aug. 4, 1998, the entire contents of which are hereby incorporated by reference.

What is claimed is:

1. An electrostatic inkjet head comprising:

a first, ink-chamber substrate comprising at least one ink chamber containing ink therein;

at least one inkjet nozzle connected to the at least one inkjet chamber; and at least one vibration plate defining a part of the at least one ink chamber, the vibration plate being constructed to be elastically deformed so as to eject a droplet of ink from the at least one inkjet nozzle; and a second, electrode substrate comprising at least one individual electrode located opposite to the vibration plate with a predetermined gap therebetween, the individual electrode formed on a single crystal silicon substrate, and comprising a silicon film containing impurity atoms providing one of an n-type and a p-type conductivity to the individual electrode; and a plurality of gap spacers disposed on the single crystal silicon substrate, the gap spacers surrounding the individual electrode, and being made of an insulating film so as to define the gap between the individual electrode and the vibration plate, said gap spacers thereby being configured and adapted to produce a substantially uniform gap.

2. The electrostatic inkjet head as claimed in claim 1, wherein the silicon film of the individual electrode contains impurity atoms at a concentration of more than about 1E18/cm$^3$.

3. The electrostatic inkjet head as claimed in claim 1, wherein the impurity atoms contained in the silicon film of the individual electrode are phosphorus atoms or arsenic atoms.

4. The electrostatic inkjet head as claimed in claim 1, wherein the impurity atoms contained in the silicon film of the individual electrode are boron atoms.

5. The electrostatic inkjet head as claimed in claim 1, wherein the individual electrode includes a silicide film disposed on the silicon film containing the impurity atoms.

6. The electrostatic inkjet head as claimed in claim 5, wherein the suicide film is made of titanium silicide.

7. The electrostatic inkjet head as claimed in claim 1, further comprising an insulating film disposed on the silicon film of the individual electrode.

8. The electrostatic inkjet head as claimed in claim 7, wherein the insulating film is made of silicon nitride.

9. The electrostatic inkjet head as claimed in claim 7, wherein the insulating film is made of silicon oxide.

10. An electrostatic inkjet head comprising:

a first, ink-chamber substrate comprising at least one ink chamber containing ink therein;

at least one inkjet nozzle connected to the at least one ink chamber; and at least one vibration plate defining a part of the at least one ink chamber, the vibration plate being constructed to be elastically deformed by an electrostatic force so as to eject a droplet of ink from the at least one inkjet nozzle; and a second, electrode substrate comprising at least one individual electrode located opposite to the vibration plate with a predetermined gap therebetween, the individual electrode formed on a single crystal silicon substrate, and comprising a silicon film containing impurity atoms providing one of an n-type and a p-type conductivity to the individual electrode; and a plurality of gap spacers provided on the single crystal silicon substrate, the gap spacers surrounding the individual electrode, and being made of an insulating film so as to define the gap between the individual electrode and the vibration plate, said gap spacers thereby being configured and adapted to produce a substantially uniform gap.

11. The electrostatic inkjet head as claimed in claim 10, wherein the silicide film is made of titanium silicide.

12. The electrostatic inkjet head as claimed in claim 11, further comprising an insulating film formed on the silicon film of the individual electrode.

13. The electrostatic inkjet head as claimed in claim 12, wherein the insulating film is made of silicon nitride.

14. The electrostatic inkjet head as claimed in claim 12, wherein the insulating film is made of silicon oxide.

15. A method for manufacturing an electrostatic inkjet head comprising the steps of:

providing a first, single crystal silicon substrate;

thermally oxidizing the single crystal silicon substrate so as to form a thermal oxidation film on the single crystal silicon substrate;

forming a silicon film on the thermal oxidation film, the silicon film containing impurity atoms;

forming a patterned silicon nitride film on the silicon film;

oxidizing parts of the silicon film containing the impurity atoms within an oxygen atmosphere so that only parts of the silicon film on which parts the silicon nitride film is not formed are oxidized, to thereby form gap spacers on the thermal oxidation film, wherein said gap spacers are configured and adapted to produce a substantially uniform gap between said first substrate and a vibration plate on a corresponding, second substrate; and performing a process for forming a vibration plate, an ink chamber and an inkjet nozzle using a second, silicon substrate.

16. The method as claimed in claim 15, wherein the step of performing a process includes the steps of bonding a vibration plate substrate formed of the another silicon substrate to the gap spacers and forming the vibration plate, the ink chamber and the inkjet nozzle by processing the vibration plate substrate.

17. The method as claimed in claim 15, wherein the step of performing a process includes the steps of bonding a vibration plate substrate formed of the another silicon substrate to the gap spacers, the vibration plate substrate being provided with the vibration plate and forming the ink chamber and the inkjet nozzle by processing the vibration plate substrate.

18. A method for manufacturing an electrostatic inkjet comprising the steps of:

providing a first, single crystal silicon substrate;

thermally oxidizing the single crystal silicon substrate so as to form a thermal oxidation film on the single crystal silicon substrate;

forming a silicon film on the thermal oxidation film, the silicon film containing impurity atoms;

forming a patterned silicon nitride film on the silicon film;

oxidizing parts of the silicon film containing the impurity atoms within an oxygen atmosphere so that only parts of the silicon film on which parts the silicon nitride film is not formed are oxidized so as to form gap spacers on the thermal oxidation film, wherein said gap spacers are configured and adapted to produce a substantially uniform gap between said first substrate and a vibration plate on a corresponding, second substrate;

removing the silicon nitride film from the silicon film;

depositing titanium on the silicon film;

forming a titanium silicide film on only the silicon film by heat treatment and etching; and performing a process for forming a vibration plate, an ink chamber and an inkjet nozzle using a second, silicon substrate.

19. The method as claimed in claim 18, wherein the step of performing a process includes the steps of bonding a vibration plate substrate formed of the another silicon substrate to the gap spacers and forming the vibration plate, the ink chamber and the inkjet nozzle by processing the vibration plate substrate.

20. The method as claimed in claim 18, wherein the step of performing a process includes the steps of bonding a vibration plate substrate formed of the another silicon substrate to the gap spacers, the vibration plate substrate being provided with the vibration plate and forming, the ink chamber and the inkjet nozzle by processing the vibration plate substrate.

21. A method for manufacturing an electrostatic inkjet comprising the steps of:

providing a first, single crystal silicon substrate;

thermally oxidizing the single crystal silicon substrate so as to form a thermal oxidation film on the single crystal silicon substrate;

forming a silicon film on the thermal oxidation film, the silicon film containing impurity atoms;

forming a patterned silicon nitride film on the silicon film;

oxidizing parts of the silicon film containing the impurity atoms within an oxygen atmosphere so that only parts of the silicon film on which parts the silicon nitride film is not formed are oxidized so as to form gap spacers on the thermal oxidation film, wherein said gap spacers are configured and adapted to produce a substantially uniform gap between said first substrate and a vibration plate on a corresponding, second substrate;

removing the silicon nitride film from the silicon film;

depositing titanium on the silicon film;

forming a titanium silicide film on only the silicon film by heat treatment and etching; and performing a process for forming a vibration plate, an ink chamber and an inkjet nozzle using a second, silicon substrate.

22. The method as claimed in claim 21, wherein the step of performing a process includes the steps of bonding a vibration plate substrate formed of the another silicon substrate to the gap spacers and forming the vibration plate, the ink chamber and the inkjet nozzle by processing the vibration plate substrate.

23. The method as claimed in claim 21, wherein the step of performing a process includes the steps of bonding a vibration plate substrate formed of the another silicon substrate to the gap spacers, the vibration plate substrate being provided with the vibration plate and forming the ink chamber and the inkjet nozzle by processing the vibration plate substrate.

* * * * *

UNITED STATES PATENT AND TRADEMARK OFFICE

CERTIFICATE OF CORRECTION

PATENT NO. : 6,454,395 B1
DATED : September 24, 2002
INVENTOR(S) : Irinoda

It is certified that error appears in the above-identified patent and that said Letters Patent is hereby corrected as shown below:

Title page,
Assignee residence, please delete "Yokohama (JP)" and substitute
-- Tokyo (JP) --

Column 24,
Line 24, please delete the word "suicide"; please substitute therefore the word
-- "silicide" --

Signed and Sealed this

Twenty-eighth Day of January, 2003

JAMES E. ROGAN
*Director of the United States Patent and Trademark Office*